US007717828B2

(12) United States Patent
Simonson et al.

(10) Patent No.: US 7,717,828 B2
(45) Date of Patent: May 18, 2010

(54) EXERCISE DEVICE WITH PIVOTING ASSEMBLY

(75) Inventors: Roy Simonson, Laguna Beach, CA (US); William T. Dalebout, Logan, UT (US); Jaremy T. Butler, Logan, UT (US)

(73) Assignee: Icon IP, Inc., Logan, UT (US)

( * ) Notice: Subject to any disclaimer, the term of this patent is extended or adjusted under 35 U.S.C. 154(b) by 0 days.

(21) Appl. No.: 11/832,634

(22) Filed: Aug. 1, 2007

(65) Prior Publication Data

US 2008/0051260 A1 Feb. 28, 2008

Related U.S. Application Data

(60) Provisional application No. 60/834,928, filed on Aug. 2, 2006, provisional application No. 60/908,915, filed on Mar. 29, 2007.

(51) Int. Cl.
*A63B 22/04* (2006.01)

(52) U.S. Cl. ..... 482/52

(58) Field of Classification Search ..... 482/51–53, 482/57, 62, 70–71; *A63B 22/04*
See application file for complete search history.

(56) References Cited

U.S. PATENT DOCUMENTS

| | | | | |
|---|---|---|---|---|
| 3,316,898 | A | 5/1967 | Brown | |
| 3,501,140 | A | 3/1970 | Eichorn | |
| 3,622,179 | A | 11/1971 | Pfersick | 280/207 |
| 3,756,595 | A | 9/1973 | Hague | |
| 3,824,994 | A | 7/1974 | Soderberg, Sr. | |
| 3,941,377 | A | 3/1976 | Lie | |
| 4,140,312 | A | 2/1979 | Buchmann | |
| 4,300,760 | A | 11/1981 | Bobroff | |
| 4,340,214 | A | 7/1982 | Schutzer | |
| 4,354,675 | A | 10/1982 | Barclay | |

(Continued)

FOREIGN PATENT DOCUMENTS

| | | |
|---|---|---|
| DE | 229712 | 1/1911 |

(Continued)

OTHER PUBLICATIONS

GEARTRENDS Fitness 2007 edition, available on information and belief at least as early as Jun. 1, 2007 (6 pages).

(Continued)

*Primary Examiner*—Loan H Thanh
*Assistant Examiner*—Oren Ginsberg
(74) *Attorney, Agent, or Firm*—Workman Nydegger

(57) ABSTRACT

A non-impact exercise device comprising a framework, resistance assembly, and a pivoting assembly. The pivoting assembly contains a pair of link arms pivotally coupled to a pair of foot support members. The link arms have handles for the user to grip and the foot support members have foot platforms for the user to stand upon. The foot platforms have a wheel attached to them and the wheel rests upon curved or arced ramps of the exercise device. The user exercises by putting force into the device through the handles and/or foot platforms. This causes the foot platforms to roll along the ramps while the user is standing upon the foot platforms. The user may readily vary the length and frequency of the reciprocating stride.

37 Claims, 23 Drawing Sheets

U.S. PATENT DOCUMENTS

| | | | | |
|---|---|---|---|---|
| 4,679,787 | A | 7/1987 | Guilbault | |
| 4,708,338 | A | 11/1987 | Potts | |
| 4,720,093 | A | 1/1988 | Del Mar | |
| 4,938,474 | A | 7/1990 | Sweeney et al. | |
| 5,013,031 | A | 5/1991 | Bull | |
| 5,039,088 | A | 8/1991 | Shifferaw | |
| 5,078,389 | A | 1/1992 | Chen | |
| 5,135,447 | A | 8/1992 | Robards, Jr. et al. | |
| 5,180,351 | A * | 1/1993 | Ehrenfried | 482/52 |
| 5,195,935 | A | 3/1993 | Fencel | |
| 5,199,931 | A | 4/1993 | Easley | |
| 5,242,343 | A | 9/1993 | Miller | |
| 5,267,922 | A | 12/1993 | Robinson | |
| 5,279,529 | A | 1/1994 | Eschenbach | |
| 5,279,531 | A | 1/1994 | Jen-Huey | |
| D344,112 | S | 2/1994 | Smith | |
| 5,290,211 | A | 3/1994 | Stearns | |
| 5,299,993 | A | 4/1994 | Habing | |
| 5,308,296 | A | 5/1994 | Eckstein | |
| 5,322,491 | A | 6/1994 | Wanzer et al. | |
| D336,141 | S | 8/1994 | Husted et al. | |
| 5,336,141 | A | 8/1994 | Vittone | |
| 5,352,169 | A | 10/1994 | Eschenbach | |
| 5,383,829 | A | 1/1995 | Miller | |
| D356,128 | S | 3/1995 | Smith et al. | |
| 5,415,607 | A | 5/1995 | Carpenter | |
| 5,419,751 | A | 5/1995 | Byrd et al. | |
| 5,423,729 | A | 6/1995 | Eschenbach | |
| 5,435,799 | A | 7/1995 | Lundin | |
| 5,435,801 | A | 7/1995 | Hung | |
| D367,689 | S | 3/1996 | Wilkinson et al. | |
| 5,499,956 | A | 3/1996 | Habing et al. | |
| 5,518,473 | A | 5/1996 | Miller | |
| 5,527,245 | A | 6/1996 | Dalebout et al. | |
| 5,527,246 | A | 6/1996 | Rodgers, Jr. | |
| 5,529,554 | A | 6/1996 | Eschenbach | |
| 5,529,555 | A | 6/1996 | Rodgers, Jr. | |
| 5,540,637 | A | 6/1996 | Rodgers, Jr. | |
| 5,549,526 | A | 8/1996 | Rodgers, Jr. | |
| 5,562,574 | A | 10/1996 | Miller | |
| 5,573,480 | A | 11/1996 | Rodgers, Jr. | |
| 5,577,985 | A | 11/1996 | Miller | |
| 5,591,107 | A | 1/1997 | Rodgers | |
| 5,593,371 | A | 1/1997 | Rodgers, Jr. | |
| 5,593,372 | A | 1/1997 | Rodgers, Jr. | |
| 5,595,553 | A | 1/1997 | Rodgers, Jr. | |
| 5,595,556 | A | 1/1997 | Dalebout et al. | |
| 5,611,756 | A | 3/1997 | Miller | |
| 5,611,757 | A | 3/1997 | Rodgers | |
| 5,611,758 | A | 3/1997 | Rodgers | |
| 5,616,103 | A | 4/1997 | Lee | |
| 5,626,542 | A | 5/1997 | Dalebout et al. | |
| 5,637,058 | A | 6/1997 | Rodgers | |
| D380,509 | S | 7/1997 | Wilkinson et al. | |
| 5,653,662 | A | 8/1997 | Rodgers, Jr. | |
| D384,118 | S | 9/1997 | Deblauw | |
| 5,672,140 | A | 9/1997 | Watterson et al. | |
| 5,683,333 | A | 11/1997 | Rodgers, Jr. | |
| 5,685,804 | A | 11/1997 | Whan-Tong et al. | |
| 5,690,589 | A | 11/1997 | Rodgers, Jr. | |
| 5,695,434 | A | 12/1997 | Dalebout et al. | |
| 5,695,435 | A | 12/1997 | Dalebout et al. | |
| 5,707,320 | A | 1/1998 | Yu | |
| 5,707,321 | A | 1/1998 | Maresh | |
| 5,722,922 | A | 3/1998 | Watterson et al. | |
| 5,738,614 | A | 4/1998 | Rodgers, Jr. | |
| 5,743,834 | A | 4/1998 | Rodgers, Jr. | |
| 5,755,642 | A | 5/1998 | Miller | |
| 5,766,113 | A | 6/1998 | Rodgers, Jr. | |
| 5,772,558 | A | 6/1998 | Rodgers, Jr. | |
| 5,779,599 | A | 7/1998 | Chen | |
| 5,782,722 | A | 7/1998 | Sands et al. | |
| 5,788,609 | A | 8/1998 | Miller | |
| 5,788,610 | A | 8/1998 | Eschenbach | |
| 5,792,026 | A | 8/1998 | Maresh et al. | |
| 5,792,029 | A | 8/1998 | Gordon | |
| 5,795,268 | A | 8/1998 | Husted | |
| 5,813,949 | A | 9/1998 | Rodgers, Jr. | |
| 5,823,917 | A | 10/1998 | Chen | |
| 5,830,113 | A | 11/1998 | Coody et al. | |
| 5,830,114 | A | 11/1998 | Halfen et al. | |
| 5,833,582 | A | 11/1998 | Chen | |
| 5,836,854 | A | 11/1998 | Kuo | |
| D403,033 | S | 12/1998 | Husted et al. | |
| 5,846,166 | A | 12/1998 | Kuo | |
| 5,855,538 | A | 1/1999 | Argabright | |
| 5,857,941 | A | 1/1999 | Maresh et al. | |
| 5,860,893 | A | 1/1999 | Watterson et al. | |
| 5,860,895 | A | 1/1999 | Lee | |
| 5,873,608 | A | 2/1999 | Tharp et al. | |
| 5,897,460 | A | 4/1999 | McBride et al. | |
| 5,899,834 | A | 5/1999 | Dalebout et al. | |
| 5,904,637 | A | 5/1999 | Kuo | |
| 5,911,649 | A | 6/1999 | Miller | |
| 5,913,751 | A | 6/1999 | Eschenbach | |
| 5,916,064 | A | 6/1999 | Eschenbach | |
| 5,919,118 | A | 7/1999 | Stearns et al. | |
| 5,924,962 | A | 7/1999 | Rodgers, Jr. | |
| D413,366 | S | 8/1999 | Husted et al. | D21/668 |
| 5,938,567 | A | 8/1999 | Rodgers, Jr. | |
| 5,938,570 | A | 8/1999 | Maresh | |
| 5,944,638 | A | 8/1999 | Maresh et al. | |
| 5,947,872 | A | 9/1999 | Ryan et al. | |
| 5,951,449 | A | 9/1999 | Oppriecht | |
| 5,957,814 | A | 9/1999 | Eschenbach | |
| 5,961,423 | A | 10/1999 | Sellers | |
| 5,997,445 | A | 12/1999 | Maresh et al. | |
| 6,001,046 | A | 12/1999 | Chang | |
| 6,004,244 | A | 12/1999 | Simonson | |
| 6,007,462 | A | 12/1999 | Chen | |
| 6,019,710 | A | 2/2000 | Dalebout | |
| 6,024,676 | A | 2/2000 | Eschenbach | |
| 6,027,431 | A | 2/2000 | Stearns et al. | |
| 6,030,319 | A | 2/2000 | Wu | |
| 6,030,320 | A | 2/2000 | Stearns et al. | |
| 6,042,512 | A | 3/2000 | Eschenbach | |
| 6,045,487 | A | 4/2000 | Miller | |
| 6,077,202 | A | 6/2000 | Gray | |
| 6,099,439 | A | 8/2000 | Ryan et al. | |
| 6,106,439 | A | 8/2000 | Boland | |
| 6,123,649 | A | 9/2000 | Lee et al. | |
| 6,123,650 | A | 9/2000 | Birrell | |
| 6,135,927 | A | 10/2000 | Lo | |
| 6,146,313 | A | 11/2000 | Whan-Tong et al. | |
| 6,149,551 | A | 11/2000 | Pyles et al. | |
| 6,165,107 | A | 12/2000 | Birrell | |
| 6,171,217 | B1 | 1/2001 | Cutler | |
| 6,176,814 | B1 | 1/2001 | Ryan et al. | |
| 6,190,289 | B1 | 2/2001 | Pyles et al. | |
| 6,196,948 | B1 | 3/2001 | Stearns et al. | |
| 6,206,804 | B1 | 3/2001 | Maresh | |
| 6,210,305 | B1 | 4/2001 | Eschenbach | |
| 6,217,486 | B1 | 4/2001 | Rosenow | |
| 6,248,044 | B1 | 6/2001 | Stearns et al. | |
| 6,261,209 | B1 | 7/2001 | Coody | |
| 6,277,055 | B1 | 8/2001 | Birrell et al. | |
| 6,315,702 | B1 | 11/2001 | Ikonomopoulos | 482/138 |
| 6,338,698 | B1 | 1/2002 | Stearns et al. | |
| 6,361,476 | B1 | 3/2002 | Eschenbach | |
| 6,368,252 | B1 | 4/2002 | Stearns | |
| 6,390,953 | B1 | 5/2002 | Maresh et al. | |
| 6,398,695 | B2 | 6/2002 | Miller | |
| 6,409,632 | B1 | 6/2002 | Eschenbach | |
| 6,422,976 | B1 | 7/2002 | Eschenbach | |

| | | | | |
|---|---|---|---|---|
| 6,422,977 | B1 * | 7/2002 | Eschenbach | 482/52 |
| 6,436,007 | B1 | 8/2002 | Eschenbach | |
| 6,440,042 | B2 | 8/2002 | Eschenbach | |
| 6,482,132 | B2 | 11/2002 | Eschenbach | |
| 6,500,096 | B1 | 12/2002 | Farney | |
| 6,544,147 | B1 | 4/2003 | Wang et al. | |
| 6,551,217 | B2 | 4/2003 | Kaganovsky | |
| 6,582,343 | B2 | 6/2003 | Lin et al. | |
| 6,612,969 | B2 | 9/2003 | Eschenbach | |
| 6,645,125 | B1 | 11/2003 | Stearns et al. | |
| 6,685,607 | B1 | 2/2004 | Olson | |
| 6,695,749 | B2 | 2/2004 | Kuo | |
| 6,730,002 | B2 | 5/2004 | Hald et al. | |
| 6,749,540 | B1 | 6/2004 | Pasero et al. | |
| 6,752,744 | B2 | 6/2004 | Arnold et al. | |
| 6,758,790 | B1 | 7/2004 | Ellis | |
| 6,783,481 | B2 | 8/2004 | Stearns et al. | |
| 6,786,850 | B2 | 9/2004 | Nizamuddin | |
| 6,821,232 | B1 | 11/2004 | Wang et al. | |
| 6,830,538 | B2 | 12/2004 | Eschenbach | |
| 6,855,093 | B2 | 2/2005 | Anderson et al. | |
| 6,875,160 | B2 | 4/2005 | Watterson et al. | |
| 6,905,441 | B2 | 6/2005 | Anderson | |
| 6,949,053 | B1 | 9/2005 | Stearns et al. | |
| 6,949,054 | B1 | 9/2005 | Stearns et al. | |
| 6,994,657 | B1 * | 2/2006 | Eschenbach | 482/52 |
| 7,025,711 | B2 | 4/2006 | Eschenbach | |
| 7,033,305 | B1 | 4/2006 | Stearns et al. | |
| 7,052,439 | B2 | 5/2006 | Anderson et al. | |
| 7,060,005 | B2 | 6/2006 | Carlsen et al. | |
| 7,097,592 | B2 | 8/2006 | Wang | |
| 7,097,600 | B2 | 8/2006 | Gray | |
| 7,153,238 | B2 | 12/2006 | Anderson et al. | |
| 7,156,776 | B2 | 1/2007 | Maser | |
| 7,169,087 | B2 | 1/2007 | Ercanbrack et al. | |
| 7,192,388 | B2 | 3/2007 | Dalebout et al. | |
| 7,201,707 | B1 | 4/2007 | Moon | |
| 7,214,167 | B2 | 5/2007 | Stearns et al. | |
| 7,214,168 | B2 | 5/2007 | Rodgers, Jr. | |
| 7,278,955 | B2 | 10/2007 | Giannelli et al. | |
| D554,715 | S | 11/2007 | Giannelli et al. | |
| D563,489 | S | 3/2008 | Giannelli et al. | |
| D564,051 | S | 3/2008 | Giannelli et al. | |
| 7,494,449 | B2 | 2/2009 | Eschenbach | |
| 7,658,698 | B2 * | 2/2010 | Pacheco et al. | 482/52 |
| 2002/0019298 | A1 * | 2/2002 | Eschenbach | 482/51 |
| 2002/0086779 | A1 | 7/2002 | Wilkinson | |
| 2002/0198084 | A1 | 12/2002 | Stearns et al. | |
| 2003/0045403 | A1 | 3/2003 | Watterson et al. | |
| 2003/0083177 | A1 | 5/2003 | Tung | |
| 2003/0092532 | A1 | 5/2003 | Giannelli et al. | |
| 2004/0077463 | A1 | 4/2004 | Rodgers, Jr. | |
| 2004/0132583 | A1 | 7/2004 | Ohrt et al. | |
| 2004/0157706 | A1 | 8/2004 | Miller | |
| 2004/0162191 | A1 | 8/2004 | Ercanbrack et al. | |
| 2004/0198561 | A1 | 10/2004 | Corbalis et al. | |
| 2004/0224825 | A1 | 11/2004 | Giannelli et al. | |
| 2005/0009668 | A1 | 1/2005 | Savettiere et al. | |
| 2005/0026752 | A1 | 2/2005 | Lull et al. | |
| 2005/0085344 | A1 * | 4/2005 | Eschenbach | 482/51 |
| 2005/0101463 | A1 | 5/2005 | Chen | |
| 2005/0130807 | A1 | 6/2005 | Cutler et al. | |
| 2005/0164837 | A1 | 7/2005 | Anderson et al. | |
| 2005/0181912 | A1 | 8/2005 | Eschenbach | |
| 2005/0202939 | A1 | 9/2005 | Lull et al. | |
| 2005/0209059 | A1 | 9/2005 | Crawford et al. | |
| 2005/0227817 | A1 | 10/2005 | Anderson et al. | |
| 2006/0019804 | A1 | 1/2006 | Young | |
| 2006/0035754 | A1 | 2/2006 | Giannelli et al. | |
| 2006/0035755 | A1 | 2/2006 | Dalebout et al. | |
| 2006/0040794 | A1 | 2/2006 | Giannelli et al. | |
| 2006/0166791 | A1 | 7/2006 | Liao et al. | |
| 2006/0217236 | A1 | 9/2006 | Watterson et al. | |
| 2006/0223678 | A1 * | 10/2006 | MacLean | 482/51 |
| 2006/0234838 | A1 | 10/2006 | Dalebout et al. | |
| 2006/0247103 | A1 | 11/2006 | Stearns et al. | |
| 2006/0287161 | A1 | 12/2006 | Dalebout et al. | |
| 2007/0060449 | A1 | 3/2007 | Lo | |
| 2007/0060450 | A1 | 3/2007 | Lo | |
| 2007/0117683 | A1 | 5/2007 | Ercanbrack et al. | |
| 2007/0123393 | A1 | 5/2007 | Giannelli et al. | |
| 2007/0123394 | A1 | 5/2007 | Ercanbrack et al. | |
| 2007/0129217 | A1 | 6/2007 | Giannelli et al. | |
| 2007/0129218 | A1 | 6/2007 | Dalebout et al. | |
| 2007/0179023 | A1 | 8/2007 | Dyer | |
| 2007/0202995 | A1 | 8/2007 | Roman et al. | |
| 2007/0202999 | A1 | 8/2007 | Giannelli et al. | |
| 2008/0032869 | A1 | 2/2008 | Pacheco et al. | |
| 2008/0051260 | A1 | 2/2008 | Simonson et al. | |
| 2008/0153674 | A9 | 6/2008 | Dalebout et al. | |
| 2008/0167163 | A9 | 7/2008 | Dalebout et al. | |
| 2008/0200314 | A1 | 8/2008 | Dalebout et al. | 482/52 |

FOREIGN PATENT DOCUMENTS

| | | |
|---|---|---|
| FR | 498.150 | 6/1916 |
| WO | WO95/00209 | 1/1995 |
| WO | WO96/08292 | 3/1996 |

OTHER PUBLICATIONS

CYBEX Cross-Training, "CYBEXceptional," including pages relating to Nova 7 award, Cybex Arc Trainer Nova 7 2004 & 2005 "Best Product of the Year," and "Total Body Arc Trainer The Evolution of Fitness Continues," printed Jun. 14, 2006 (4 pages).

www.cybexintl.com/Products, "Total Body Arc Trainer," printed Jun. 14, 2006 (1 page).

www.cybexintl.com/Products, Arc Trainer, printed Jun. 14, 2006 (1 page).

www.cybexinternational.com, "Total Body Arc Trainer" and "Total Body Arc Trainer" Product #630A, available on information and belief at least as early as Apr. 4, 2007 (2 total pages).

www.cybexinternational.com, "Self Powered Total Body Arc," printed Apr. 4, 2007 (1 page).

www.cybexinternational.com, "425A Arc Trainer," printed Apr. 4, 2007 (1 page).

www.cybexinternational.com, "Home Arc Trainer," printed Apr. 4, 2007 (1 page).

www.nautilus.com, Nautilus® EV718 Pro Series Elliptical, printed Jun. 21, 2006 (2 pages).

"Arc Trainer Specifications," copyright 2005 (1 page).

Sports Authority Newspaper Advertisement, "All Ellipticals and Bikes on Sale," Deseret Morning News, Dec. 6, 2006, one page.

Operations Manual, Q35/Q35e/Pro35, Octane Fitness, 48 pages, copyright 2004.

Operations Manual, Q35, Octane Fitness, 28 pages, copyright 2006.

Assembly Manual, Q35, Octane Fitness, 12 pages, copyright 2006.

Brochure: "EFX 5.37 Elliptical Fitness Cross Trainer," 2 pages, copyright 2007.

Brochure: "EFX 5.17 Elliptical Fitness Cross Trainer," 2 pages, copyright 2006.

www.precor.com, Internet pages relating to EFX Elliptical Fitness Cross Trainer, printed Jan. 3, 2008, 5 pages.

Picture of Summit Trainer Exercise Device, which was available on information and belief at least as early as Jul. 2006, 1 page.

www.us.commercial.lifefitness.com, "Summit Trainers," printed Oct. 17, 2006 (3 pages).

Internet archive for www.us.commercial.lifefitness.com, at http://web.archive.org/web/20061016230321/us.commerical.lifefitness.com/, "Summit Trainers," available on information and belief at least as early as Oct. 16, 2006 (3 pages).

"95Le Summit Trainer" and "95Le Summit Trainer Specifications," copyright 2006 (2 pages).

www.uk.corporate.lifefitness.com, "Life Fitness Joins as Associate Sponsor of the 2006 LaSalle Bank Chicago Marathon," printed on Jan. 4, 2008 (2 pages).

Brochure: "Summit Trainers, The latest innovation in cardiovascular exercise," 3 pages, available on information and belief at least as early as Jul. 17, 2007 (includes brochure pp. 38-41, 66).
Brochure: "Reach Your Summit," 7 pages, available on information and belief at least as early as Nov. 1, 2006.
Operations Manual, 95Le Summit Trainer, LifeFitness, 53 pages, copyright 2006.
Operations Manual, 95Li Summit Trainer, LifeFitness, 39 pages, copyright 2006.
Assembly Instructions, 95Li Summit Trainer, LifeFitness, 10 pages, available on information and belief at least as early as Dec. 18, 2006.
LifeFitness, "Biomechanical Research Presents Benefits of New Summit Trainer," copyright 2006 (2 pages).
Vision Fitness-About Our Ellipticals, www.visionfitness.com, printed Sep. 13, 2005.
Photographs of Octane Fitness Exercise Device, available on information and belief at least as early as Sep. 2006, 8 photographs (3 pages).
Horizon Series E30 E20, printed on Jul. 27, 2004 from www.horizonfitness.com/horizon-series/ellipticals/e20.php, (1 page).
Horizon Elliptical Specs, printed on Jul. 27, 2004 from www.horizonfitness.com/horizon- series/ellipticals/elliptical-spec.php, (1 page).
User's Manual, NordicTrack CX 998, Model No. 70950, 28 pages, available on information and belief at least as early as Jan. 29, 2005.
User's Manual, NordicTrack EX 1000 Commercial Pro, Model No. NTEL 4255.1, 28 pages, available on information and belief at least as early as May 24, 2006.
User's Manual, Pro-Form XP 520 Razor Elliptical Exerciser, Model No. 831.23744.0, 28 pages, available on information and belief at least as early as Jun. 19, 2007.
Operations Manual, Q47/Q47e/Q47ce Exercise Device, Octane Fitness, 52 pages, copyright 2007.
Quality Control Checklist, Q47 Deluxe Console, Document No. 102389-001 Rev. A, dated Jun. 13, 2007, 1 page.
Quality Control Checklist, Q47 Base, Document No. 102387-001 Rev. A, dated Jun. 13, 2007, 1 page.
Octane Fitness table listing Q47 Specs, Q37 Specs, and Q35 Specs, available on information and belief at least as early as Sep. 2007, 1 page.
Internet archive for www.octanefitness.com, "Octane Fitness: Front Page," available on information and belief at least as early as Jun. 29, 2005 (1 page).
Internet archive for www.octanefitness.com, "Home Products," available on information and belief at least as early as Jun. 12, 2005 (1 page).
Internet archive for www.octanefitness.com, "Press Room," available on information and belief at least as early as Dec. 20, 2005 (1 page).
Internet archive for www.octanefitness.com, "Research," available on information and belief at least as early as Sep. 8, 2005 (1 page).
Internet archive for www.octanefitness.com, "Service," and "Club Products," available on information and belief at least as early as Apr. 9, 2005 (2 pages).
Internet archive for www.octanefitness.com, Testimonial pages, available on information and belief at least as early as Oct. 23, 2005 (11 pages).
Internet archive for www.octanefitness.com, pages entitled "Feel" (4 pages) and "Electronics" (2 pages), available on information and belief at least as early as Jan. 3, 2006 (6 total pages).
Internet archive for www.octanefitness.com, entitled "Feel," available on information and belief at least as early as Dec. 22, 2005 (1 page).
Internet archive for www.octanefitness.com, pages entitled "Why are elliptical trainers so popular," "Effectiveness of Elliptical Trainers," Impact your life, not your body! "Total Body Workout," "Minimal Maintenance," "Small Footprint," "Retailers," available on information and belief at least as early as Dec. 31, 2005 (7 pages).
Internet archive for www.octanefitness.com, pages entitled, "Elliptical Cross Training," (3 pages), "Body-Mapping Ergonomics," (2 pages) and "Elliptical Trainers and Pregnancy," (3 pages) available on information and belief at least as early as Dec. 26, 2005 (8 total pages).
Internet archive for www.octanefitness.com, pages entitled, "White Papers," "Company History," "Electronics," "Programs Q45/Q45e," "Programs Pro35," "Programs Pro350/Pro350XL," "X-Mode+ Pro35/Pro350/Pro350XL," "X-Mode Q35 and Q45," "X-Mode+ Q35e/Q45e," "X-Mode+ Pro35/Pro350/Pro350XL," " SmartStride Q45/Q45e," "SmartStride Q45/Q45e," "Elliptical Shopping Guide," " Specs," (2 pages), Consumer Guide Best Buy, "Octane Q45e," Consumer Guide Best Buy, "Octane Q35e," "Heart Rate Training," (3 pages), available on information and belief at least as early as Mar. 14, 2006 (20 total pages).
Office Action in U.S. Appl. No. 11/832,496 dated Aug. 14, 2008.
Office Action in U.S. Appl. No. 11/832,496 dated Dec. 15, 2008.
Office Action dated Jun. 2, 2009 from U.S. Appl. No. 11/832,496 (29 pages).
International Search Report mailed Jul. 16, 2008 from PCT Application No. PCT/US2007/075108 (3 pages).
International Search Report mailed Apr. 4, 2008 from PCT Application No. PCT/US2007/075112 (2 pages).

* cited by examiner

EXERCISE DEVICE WITH PIVOTING ASSEMBLY

RELATED APPLICATIONS

The present application claims priority to and the benefit of U.S. Provisional Patent Application Ser. No. 60/834,928, filed Aug. 2, 2006 and entitled "EXERCISE DEVICE WITH PIVOTING ASSEMBLY," the disclosure of which is incorporated herein by reference in its entirety; the present application also claims priority to and the benefit of U.S. Provisional Patent Application Ser. No. 60/908,915, filed Mar. 29, 2007 and entitled "VARIABLE STRIDE EXERCISE DEVICE WITH RAMP, the disclosure of which is incorporated herein by reference in its entirety. U.S. Utility patent application Ser. No. 11/832,496, entitled "Variable Stride Exercise Device with Ramp," with inventors Chad R. Pacheco, Farid Farbod, William Dalebout, and Jeremy Butler and filed on Aug. 1, 2007, the same day as the filing date of present application, is also incorporated herein, in its entirety, by reference.

THE FIELD OF THE INVENTION

The present invention relates to exercise equipment. More particularly, the invention relates to a non-impact exercise device with a reciprocating motion.

THE RELEVANT TECHNOLOGY

In light of the intense modern desire to increase aerobic activity, exercises including jogging and walking have become very popular. Medical science has demonstrated the improved strength, health, and enjoyment of life which results from physical activity.

Despite the modern desire to improve health and increase cardiovascular efficiency, modern lifestyles often fail to readily accommodate accessible running areas. In addition, weather and other environmental factors may cause individuals to remain indoors as opposed to engaging in outdoor physical activity.

Moreover, experience in treating exercise related injuries has demonstrated that a variety of negative effects accompany normal jogging. Exercise-related knee damage, for example, often results in surgery or physical therapy. Joints are often strained when joggers run on uneven surfaces or change direction. Other examples of common injuries resulting from jogging, particularly on uneven terrain, include foot sores, pulled muscles, strained tendons, strained ligaments, and back injuries.

As the population ages, there is a considerable need for exercise devices that have no impact on the joints. Hip and knee replacements are very expensive to the individual and to society in general. To the extent that joint replacements may be avoided, it is useful to have exercise devices that allow for an extreme workout without the potential strain imparted onto the load-bearing joints of the user.

There is a long standing need in the general area of exercise devices for a non-impact device with a reciprocating motion that approximates a variety of real world exercise movements. There are a variety of non-impact exercise devices that have a cyclical motion, such as elliptical trainers. Most of these types of exercise devices have the disadvantage of not being able to adjust the stride length of the exercising motion. With the same repetitive and unchangeable movement, the user is relegated to using the same sets of muscles to the detriment of other muscles.

Therefore, there is a need for an exercise device that enables the user to change the stride length and to experience entirely different striding motions using the same device. This way, a user may work different groups of muscles and also fight the boredom and potential overuse problems associated with the extreme repetition of many exercise devices.

BRIEF SUMMARY OF THE PREFERRED EMBODIMENTS

This invention is a non-impact, striding exercise device with a pivoting assembly capable of a variety of exercise motions. A user mounts the exercise device by stepping onto the foot platforms and holding onto the handles. The foot platforms are each attached to a foot support member. The foot support members are each pivotally attached to the bottom of a link arm having a top end that is pivotally attached to the framework of the exercise machine. The handles are also attached to the framework, in one embodiment, near the top end of the link arms. In this way, the user mounts the pivoting assembly of the exercise device. The user then engages in a reciprocating, striding motion by putting force into the foot platforms and/or the handles. Movement of either the handles or the foot platforms causes the foot platforms to roll along underlying ramps that are attached to the framework of the exercise device. It is the shape of these underlying ramps that dictate the path of the exercise movement that the user experiences.

The present invention provides a non-impact exercise device that allows a user to simulate the striding movements of walking, hiking, running or other exercise motions, in a minimal amount of space. This combines a reduction in injury potential with a total body workout capability in a single exercise device.

An advantage of the present invention is for the user to be able to choose the length of their stride. In order for the user to be able to adjust the length of their reciprocating stride, the user must be able to easily initiate the reciprocal movement of the pivoting assembly with a minimal input of force. The present exercise device is designed so that it is easy for the user to enter into a linearly reciprocating motion without having to overcome the substantial inertia commonly experienced while reversing direction while using other reciprocating exercise devices, such as elliptical exercise devices. Elliptical exercise devices often use a crank and a heavy flywheel that combine to fix the path of the user's motion into a cycle that impels itself and makes it difficult for the user to reverse direction. The present exercise device is designed such that the direction of the pivoting assembly and the foot platform is easily reversed with a minimal input of force from the user. This enables the user of the exercise device to be able to easily change their stride length from the infinitesimal all the way up to the user's maximum stride. The ability of the user of the exercise device to determine their own stride length is not only beneficial to users of different heights, but also allows the same user the flexibility to vary their workout on the exercise device by adjusting the length and frequency of the striding motion.

The present exercise device is capable of being adjusted to encompass a broad range of exercising motions. The striding motions are determined by the shape of the ramps. Just by changing the shape of the ramps, the striding motions could vary from substantially horizontal, like the motion associated with a cross-country ski simulator, all the way to a substantially vertical motion such as a user would experience while hiking up a very steep slope. A ramp may also be curved or arced to impart a particular ergonomic benefit upon the user.

The present exercise device is compact. The main components of the framework are contained within the boundaries created by the movement of the pivoting assemblies. Along with the overall simplicity of the design, this feature helps to create an exercise device that is substantially compact.

An advantage of certain embodiments of the present invention is that the user has unobstructed access to the exercise device. An advantage of certain embodiments of the present invention is the ease of entry and simplicity of the design which allows a smaller footprint.

These and other features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFRRED EMBODIMENTS

Figure 1:
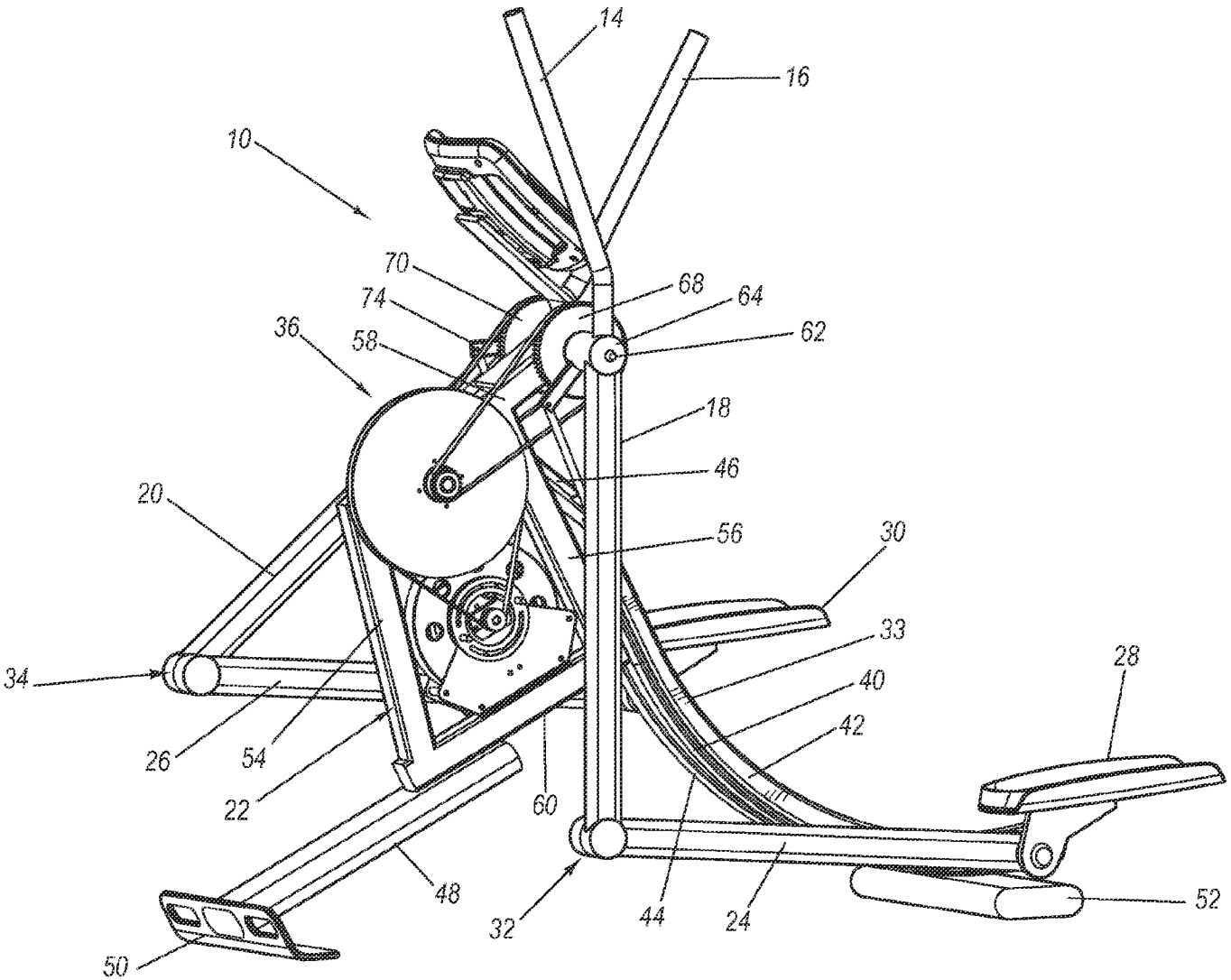
FIG. 1 is a side perspective view of an embodiment of the present invention showing an exercise device with a pivoting assembly.

The exercise device of the present invention is a non-impact, striding exercise device that enables a variety of exercise movements. Referring initially to FIGS. 1-6, exercise device 10 comprises (i) a framework 12, (ii) a pair of spaced apart handles 14, 16 that pivot on framework 12, (iii) a pair of spaced apart link arms 18, 20 that pivot on beam assembly 22, (iv) a pair of spaced apart foot support members 24, 26 that are pivotally attached to respective link arms 18, 20, (v) a pair of spaced apart foot platforms 28, 30 that are attached to respective foot support members 24, 26.

First link arm 18 and first foot support member 24 form a first pivoting assembly 32. Second link arm 20 and second foot support member 26 form a second pivoting assembly 34. Pivoting assemblies 32, 34 further comprise first foot platform 28 for first pivoting assembly 32 and second foot platform 30 for second pivoting assembly 34. Pivoting assemblies 32, 34 further comprise a first handle 14 for first pivoting assembly 32 and a second handle 16 for second pivoting assembly 34. Resistance to the movement of pivoting assemblies 32, 34, comes from a resistance assembly 36.

Framework 12 comprises a ramp assembly 38 and a beam assembly 22. Ramp assembly 38 comprises a ramp frame member 40, a first ramp 42, and a second ramp 44 attached to each first and second side of ramp frame member 40. The free end of each foot support member 24, 26, is freely movable and can be lifted off each respective ramp 42, 44. As a result of the use of freely movable ends of each foot support member 24, 26, the path that respective foot platforms 28, 30 travel is defined by the shape of the underlying ramps 42, 44, respectively. The shape of ramps 42, 44 may be arced. The shape of ramps 42, 44 may also be curved and have a variety of different shapes, such as straight, linear, and other possible shapes. In an embodiment of the exercise device of the present invention, instead of two spaced apart ramps, there may be a single ramp.

The user can move in a reciprocating manner through a variety of stride paths with very small, incremental movements (e.g., 1 inch) or very large movements (e.g., 3 feet or more), as opposed to elliptical devices that have a predefined and immutable path. The user's stride length is limited by the length of ramps 42, 44. As will be discussed later, in an embodiment of the present invention, the use of four-bar foot support members enables the foot platforms to remain at an ergonomically favored angle throughout the stride path.

Framework 12 and resistance assembly 36 are substantially located in between first pivoting assembly 32 and second pivoting assembly 34. This allows easy access to the exercise device.

In another alternative embodiment, as will be discussed later, the framework may be selectively inclined, e.g., through the use of an adjustable screw motor inserted in between parts of the framework.

In another alternative embodiment, as will be discussed later, the framework may include side-arm supports and rear supports which allow the use of shortened link arms and foot support members, further reducing the footprint of the framework, e.g., through the attachment of the shortened link arms and support members to the additional framework.

By way of example and not limitation, the invention is described by making reference to figures illustrating a general way in which the invention may be implemented, and to diagrams that illustrate the structure of embodiments used to implement the exercise device. The diagrams should not be construed as limiting of the present invention's scope, but as illustrating an example of certain presently understood embodiments of the invention.

Turning now to the drawings, FIGS. 1-6 refer to embodiment 10 of the exercise device that has a dependent movement of pivoting assemblies 32, 34 and also has a beam assembly 22 and ramp assembly 38 that are rigidly connected.

FIG. 1 is a perspective view of exercise device 10. The movement of a first side's pivoting assembly 32 is reciprocally dependent upon the movement of the second side's pivoting assembly 34. FIG. 1 shows ramps 42, 44, link arms 18, 20, foot support members 24, 26, foot platforms 28, 30, framework 12, beam assembly 22, ramp assembly 38 and resistance assembly 36.

A reciprocal swinging tube 46 connects the movement of first pivot assembly 32 to second pivot assembly 34. Thus, the movement of the first side of device 10 is linearly opposite to the second side of device 10. When first foot platform 28 is at the top of first ramp 42, second foot platform 30 is at the bottom of second ramp 44. As first foot support member 24 begins to move down first ramp 42 on the first side of exercise device 10, second foot support member 26 begins to move up second ramp 44 on the second side of exercise device 10.

Framework 12 as shown in FIG. 1 comprises ramp assembly 38, a leg member 48, a first stabilizer member 50 attached to leg member 48, a second stabilizer member 52, and beam assembly 22. Beam assembly 22 is substantially square shaped and rigidly connected, having a front beam 54, a back beam 56, a top beam 58 and a bottom beam 60. The bottom portion of beam assembly 22 is mounted to the top portion of ramp assembly 38. The bottom portion of ramp assembly 38 is attached, crosswise, to second stabilizer member 52. Second stabilizer member 52 rests upon the support surface.

A main pivot shaft 62 is coupled to the proximal portion of top beam 58, e.g., by extending transversely there through. Main pivot shaft 62 is surrounded by a first pivot sleeve 64 and a second pivot sleeve 66. First and second pivot sleeves 64, 66 are movably mounted on opposing sides of main pivot shaft 62. First pivot sleeve 64 and second pivot sleeve 66 each have a respective handle 14, 16, a respective link arm 18, 20, a respective drive sprocket 68, 70, and a respective reciprocal swinging stub 72, 74 mounted thereon.

Link arms 18, 20 have a top end and an opposed, bottom end. At the top end, link arms 18, 20 are connected to respective pivot sleeve 64, 66 which surround main pivot shaft 62. At their bottom end, link arms 18, 20 are pivotally connected to the distal end of respective foot support member 24, 26.

The proximal end of foot support members 24, 26 are attached to respective foot platforms 28, 30. In embodiments 10, 10*a*, 10*b* foot platforms 28, 30 are connected to respective foot support members 24, 26 such that the angle of foot platform 28, 30 relative to the support surface does not significantly change throughout the striding motion.

The user stands on foot platforms 28, 30. Foot support members 24, 26 roll along respective ramps 42, 44 on respectively attached wheels 76, 78. First wheel 76 and second wheel 78 attach to the proximal end of respective foot support members 24, 26, near where respective foot platforms 28, 30 are attached. Foot platforms 28, 30 and the proximal end of foot support members 24, 26 are free to move in the same plane defined by ramps 42, 44. Foot platforms 28, 30 and the proximal end of foot support members 24, 26 may move freely, and may be lifted off ramps 42, 44. However, when wheels 76, 78 attached to respective foot platforms 28, 30 are resting upon respective ramps 42, 44, the movement of the proximal end of foot support members 24, 26 and foot platforms 28, 30 are determined by the shape of respective underlying ramps 42, 44 upon which respective foot platforms 28, 30 rest.

Handles 14, 16 are mounted to respective pivot sleeves 64, 66 at an ergonomically favorable angle. Force may be imparted into exercise device 10 through handles 14, 16. Handles 14, 16 travel through a path similar to what the user's arms and hands would experience while walking or running. The movement of handles 14, 16 is coupled to the movement of respective link arms 18, 20 because both are mounted to respective pivot sleeves 64, 66 covering main pivot shaft 62.

Ramps 42, 44 are mounted to ramp frame member 40 of ramp assembly 38. First ramp 42 is mounted on the first side of ramp frame member 40 and second ramp 44 is mounted to the second side of ramp frame member 40. Ramps 42, 44 may be substantially shorter than the length of ramp frame member 40. Ramps 42, 44 may run substantially the entire length of ramp frame member 40. Ramps 42, 44 may also be longer than ramp frame member 40 of ramp assembly 38.

Ramps 42, 44 may be shaped in a wide range of different arcs. The shape of ramps 42, 44 may be substantially arced with a large vertical gain. The shape of ramps 42, 44 may also be arced such that the overall shape is substantially horizontal.

Ramps 42, 44 may also be a curved shape such that the path foot platforms 28, 30 travel along respective ramps 42, 44 is a range of curved shapes. Ramps 42, 44 may have many curves comprising its overall shape. The shapes of the curves are dependent upon what kind of movement/workout the user wants. The human body's natural hip, knee and ankle movements may be factored into the design of ramps 42, 44. The movement of the joints throughout the stride can be engineered to conform to the natural motion of the hips, knees and ankles such that awkward, painful and unnatural angles are avoided. In an alternative embodiment, ramps 42, 44 are straight. In an alternative embodiment, ramps 42, 44 are joined together to form a single ramp.

In an embodiment of the present invention, resistance assembly 36 may comprise a first drive sprocket 68, a second drive sprocket 70, a first belt 82, a second belt 84, a drive pulley 86 and a braking device 88. Belts 82, 84 are linked to respective drive sprockets 68, 70. Although illustrated with belts 82 and 84, it will be apparent to one skilled in the art that alternative means may be used, such as cables. Cables may comprise any elongate member, such as belts, ropes or chains, for example. Resistance assembly 36 is substantially enclosed within the central portion of beam assembly 22 of exercise device 10.

The movement of pivoting assemblies 32, 34 imparts a rotational force on respective pivot sleeves 64, 66, thereby rotating respective drive sprockets 68, 70, which in turn move respective power belts 82, 84 which are linked to and engage drive pulley 86 which is linked to braking device 88.

The movement of pivoting assemblies 32, 34 comprises two strokes, a power stroke and a return stroke. The power stroke is the movement when pivoting assemblies 32, 34 impart energy into resistance assembly 36. The return stroke is the opposite movement and does not impart energy into resistance assembly 36. In embodiment 10, the power stroke would correlate to the downward motion of foot platforms 28, 30. In this particular embodiment, the user would push down on either of foot platforms 28, 30, and thereby impart energy into resistance assembly 36.

Near the periphery of each opposing end of drive pulley shaft 90, there is a one-way clutch that allows drive pulley shaft 90 to spin freely in one rotational direction and to engage drive pulley 86 in the other rotational direction. Energy is imparted into resistance assembly 36 when first drive sprocket 68 or second drive sprocket 70 moves respective power belt 82, 84 in a direction that engages drive pulley shaft 90. For example, a counterclockwise rotation of drive pulley shaft 90 would engage drive pulley 86 on a first side of device 10*a* and a clockwise rotation of drive pulley shaft 90 would engage drive pulley 86 on a second side of exercise device 10.

Drive pulley 86 is coupled to braking device 88 by a belt that runs around the circumference of drive pulley 86 and connects to a drive shaft of braking device 88. Braking device 88 is also a flywheel, storing angular momentum as the exercise device is being used. Braking device 88 may be used as a brake in order to retard the rotation of drive pulley 86. Braking device 88 may be an eddy brake, for example. In an embodiment, braking device 88 is responsible for generating the current necessary to power the display and computer of the exercise device.

Figure 2:
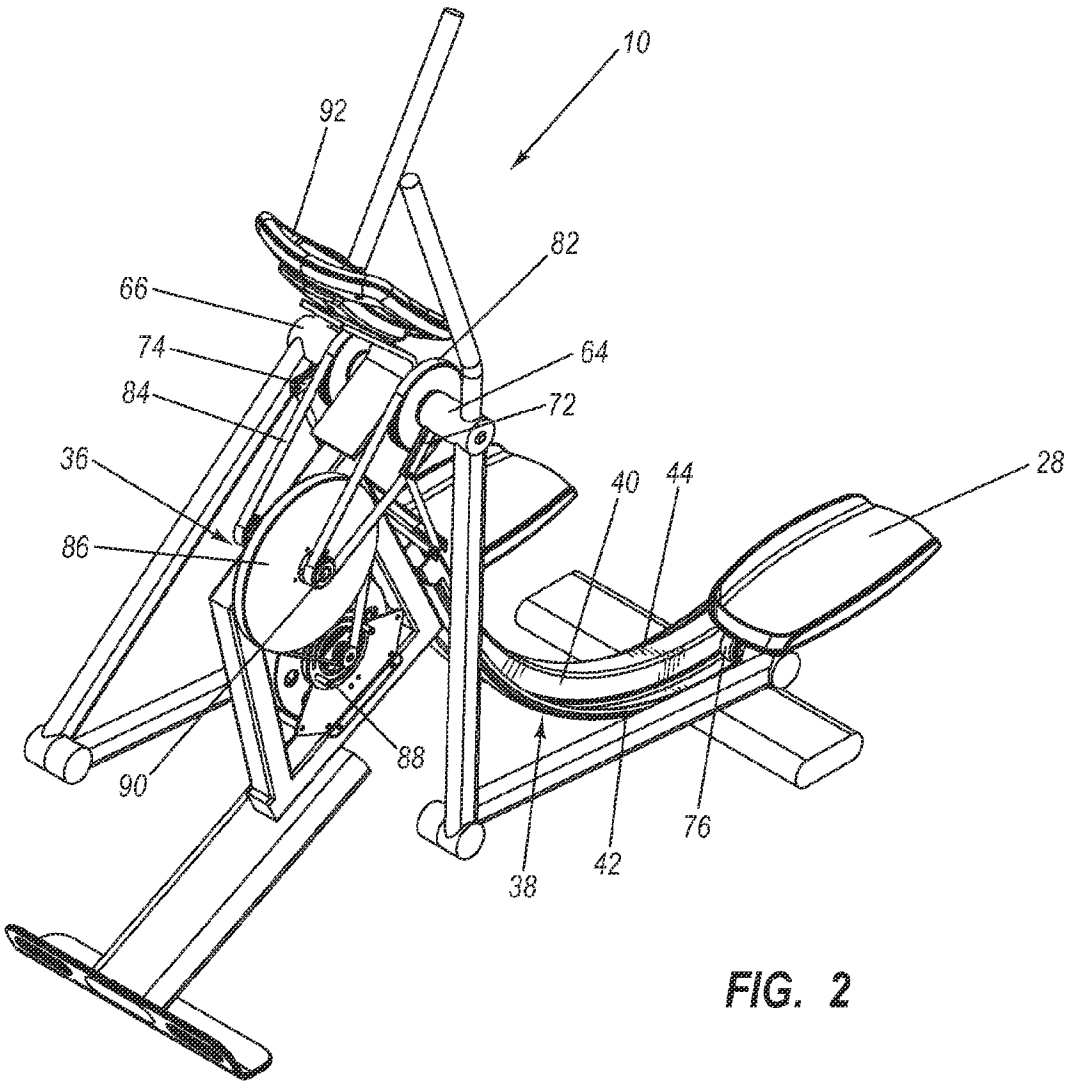
FIG. 2 is another perspective view of the exercise device of FIG. 1.

FIG. 2 is a side perspective of embodiment 10, highlighting resistance assembly 36 substantially contained within the central part of beam assembly 22.

Figure 3:
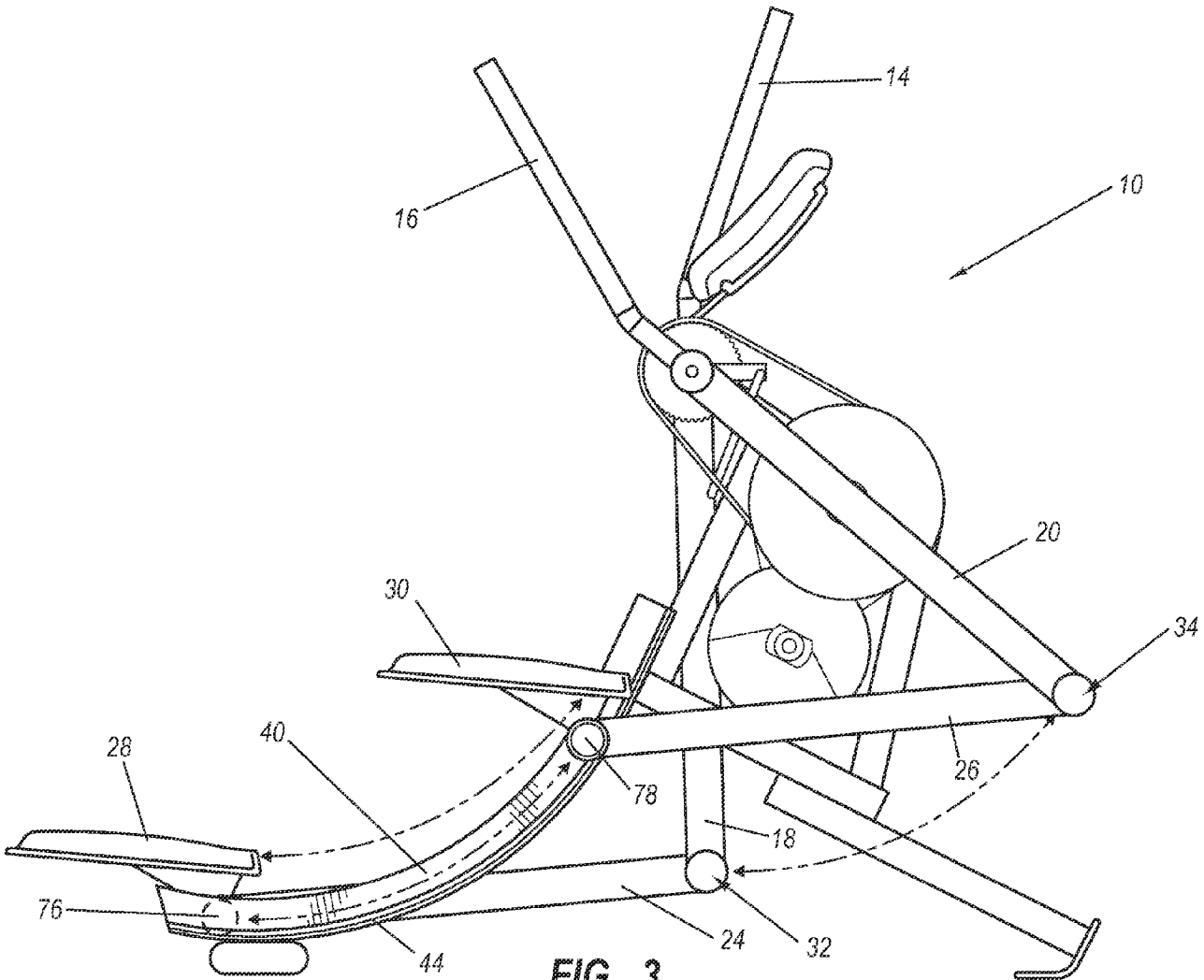
FIG. 3 is a side view of the embodiment of the exercise device of FIG. 1 depicting movement of the foot platforms upon the ramps of the framework and showing that the movement of the pivoting assemblies and foot platforms follow substantially the same arced path.

FIG. 3 shows a side view of embodiment 10. FIG. 3 represents the movement of link arms 18, 20, handles 14, 16, and foot support members 24, 26, as foot platforms 28, 30 move along respective ramps 42, 44. A bidirectional arrow on ramp frame member 40 of ramp assembly 38 shows the movement of foot support members 24, 26 along respective ramps 42, 44. Foot platforms 28, 30 are attached to the proximal end of respective foot support members 24, 26 and are free to move through any path in the plane of respective pivoting assemblies 32, 34. When a user imparts force through handles 14, 16 or foot platforms 28, 30, wheels 76, 78 roll along a path defined by the shape of underlying ramps 42, 44, respectively. The movement of wheels 76, 78 along respective ramps 42, 44 of FIG. 3 traces out a generally arced shape, but may be any variety of arcs or curves depending on the shape of underlying ramps 42, 44.

FIG. 3 further helps to illustrate the moving parts of embodiment 10. Handles 14, 16, link arms 18, 20, foot support members 24, 26 and foot platforms 28, 30 are all in motion while exercise device 10 is in use.

FIG. 3 illustrates another advantage of the present invention over the prior art. The exercise device has a variable stride length. The overall stride length may be varied from a barely perceptible movement all the way out to the limit of the lengths of ramps 42, 44. In some embodiments of the exercise device, the user's stride may be greater than 3 feet. The length of the stride is limited by the length of attached ramps 42, 44. The advantages of having a large and variable range of motion will be appreciated by any user of exercise devices. Users of different heights can determine what the comfortable range of motion is for them. A user is not limited to a "one size fits all" reciprocating device where the path of the movement is fixed. The infinitely variable stride length allows a user of any height to get a complete range of motion while using the exercise device. If the user wants a full range of motion in order to increase the difficulty of the striding motion, or for a more complete stretch of the tendons, ligaments and muscles of the legs, the user has the option of inputting enough force to create a long stride.

If the user wants to work at a higher frequency with a smaller range of motion, the user can abrogate the stride motion by changing the directional input through foot platforms and/or handles 14, 16. Elliptical exercise devices commonly have a crank that fixes the motion as well as a flywheel that makes changing the direction of the motion difficult. The user of an elliptical device is typically limited to movement within the elliptical cycle of motion prescribed by the crank. The user of a typical elliptical device must overcome the substantial inertia of the flywheel in order to change direction. Because the exercise device of the present invention has foot support members 24, 26 with free ends, and because ramps 42, 44 may be configured in alternative embodiments to have various shapes and curves, there is no fixed path that the user's stride is limited to. Unlike an elliptical device, the stride length of the present exercise device is not predefined and unchangeable.

An additional benefit of the present invention is that it is substantially more compact than other exercise devices on the market. FIG. 3 depicts the long potential stride length relative to the overall longitudinal footprint of embodiment 10 of the exercise device. Ramp length may be as much as around 50% of the overall length of the exercise device, for example. The amount of movement that the user experiences is very large compared to the small lengthwise footprint of the exercise device. This is a substantial improvement.

FIG. 3 focuses upon the arced swinging motion of foot platforms 28, 30 along ramps 42, 44 and shows the substantially same arced swinging motion of pivoting assemblies 32, 34. The shape of the arcs is primarily determined by the shape of ramps 42, 44. Alternate shaped ramps, which can be used in the present invention, produce an alternately shaped arc.

Figure 4:
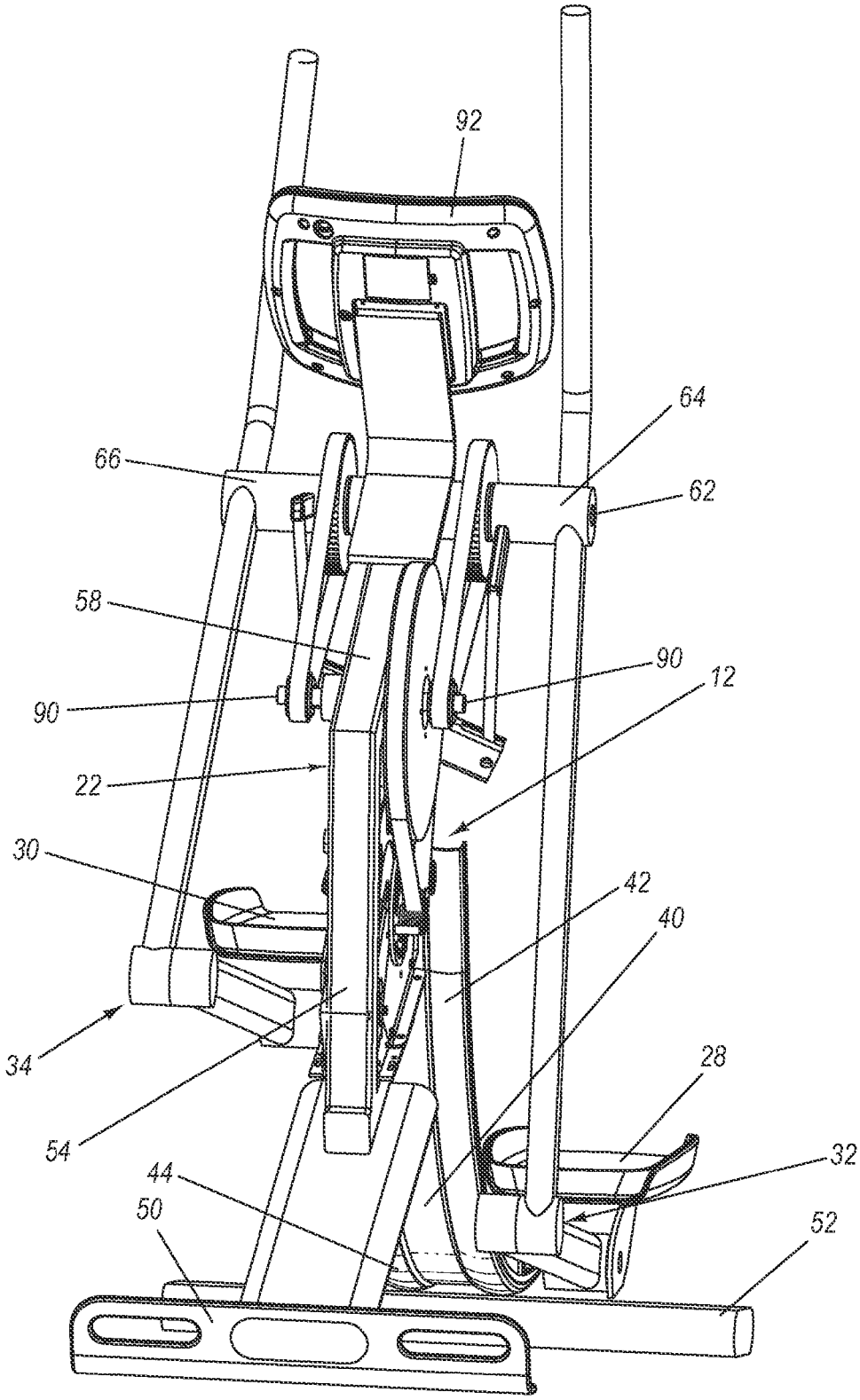
FIG. 4 is a front view of an embodiment of the exercise device of FIG. 1.

FIG. 4 shows a front perspective of embodiment 10. This perspective highlights the control console 92, beam assembly 22, foot platforms 28, 30, stabilizer members 50, 52 and ramps 42, 44.

FIG. 4 also depicts the narrow horizontal footprint of the exercise device. Compared to other exercise devices that have a cage around their moving parts, this exercise device is narrow. Since framework 12 is substantially enclosed between first pivoting assembly 32 and second pivoting assembly 34, the overall footprint of the exercise device is substantially smaller than other devices on the market. For example, in typical elliptical exercise devices, the moving parts of the exercise device are within a large assembly that prevents the device from falling over. One advantage of the current exercise device is that the size, and hence the footprint on the support surface, is substantially contained within the moving parts of the device. This decreased footprint offers substantial benefits to both the home user and the commercial user. The present exercise device takes up less space in the home of the user as well as increasing the amount of floor space available in a commercial gym that offers the present exercise device instead of other devices.

Figure 5:
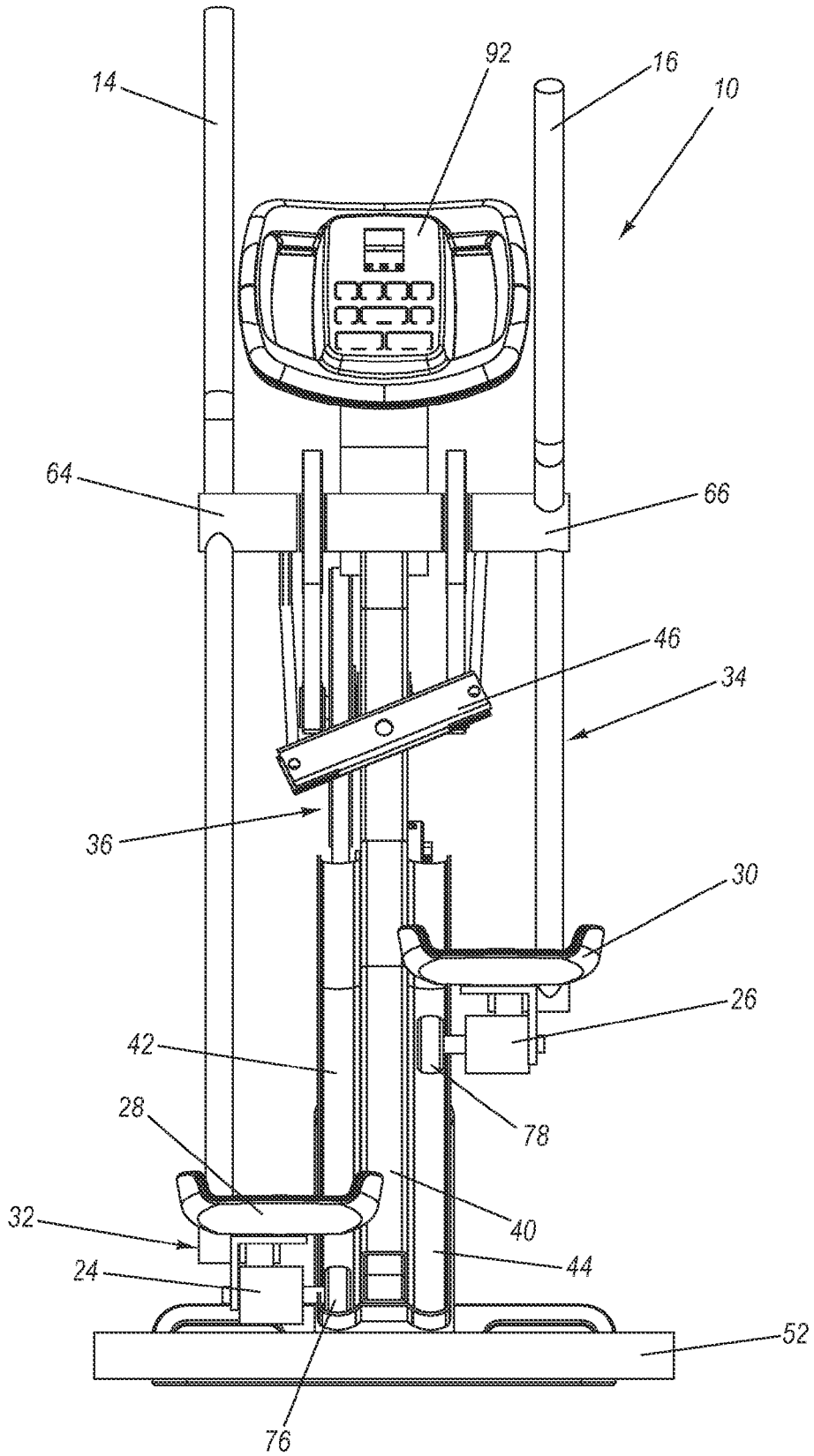
FIG. 5 is a rear view of an embodiment of the exercise device of FIG. 1.

FIG. 5 depicts embodiment 10 from a rear perspective. Reciprocal swinging tube 46 is highlighted in this perspective. Reciprocal swinging tube 46 is responsible for the dependent, reciprocal nature of the movement of first pivoting assembly 32 to second pivoting assembly 34. Wheels 76, 78 attached to respective foot support members 24, 26 are also prominently displayed in this perspective.

The path of wheels 76, 78 upon respective ramps 42, 44 is shown from another view in FIG. 5. Ramps 42, 44 offer two termini for the travel of respective wheels 76, 78; the upper terminus, near the top of respective ramps 42, 44, and the lower terminus, near where respective ramps 42, 44 connect to second stabilizer member 52.

The movement of pivoting assemblies 32, 34 can duplicate a movement that is essentially the natural gait of a walking person. While the user of the present exercise device is standing upon foot platforms 28, 30, they may put the exercise device into motion by imparting a force through handles 14, 16 and/or foot platforms 28, 30. For example, when the user moves their second foot in a proximal direction from the neutral position, the first foot will move distally from the neutral position. The neutral position is defined as the position of the device and user when foot platforms 28, 30 are laterally adjacent to one another. In this way, the movement of foot platforms 28, 30 are reciprocally related to one another.

The user may also impart a force into handles 14, 16 which will help or hinder the movement of foot platforms 28, 30 along ramps 42, 44. In the normal use of the exercise device, a user may impart force through handles 14, 16 in an arm forward, opposite-foot forward as they would in a normal gait.

In a typical elliptical exercise device, there is a significant amount of momentum associated with the movement of the crank and foot supports. The angular momentum conserved in the motion of the foot platforms of elliptical devices makes it is easier to maintain movement in the elliptical pattern as determined by the crank. For the user who wants to frequently change the direction of the elliptical motion, the substantial momentum of the flywheel makes it very difficult to change direction. A significant amount of force must be put into an elliptical device in order to change the direction from clockwise to counterclockwise, or vice versa.

An advantage of the present exercise device is that the user may easily change the length and frequency of the reciprocal stride with only a minimal input of force. The exercise device of the present invention has a movement that is reciprocating in nature, but it is not limited to the path created by a crank, nor is it inseparably tied to the momentum created by a flywheel. In order to reciprocate their stride, the user of the exercise device need only to move their foot/hand in an opposite direction with a force commensurate with changing the movement of the foot/hand during a normal walking or running gait. In contrast, the user of an elliptical device must strain to put in enough force to change the direction of rotation of the flywheel/crank/foot platform apparatus. Thus, the present exercise device offers a non-impact, natural-gait movement and requires input forces commensurate with the natural movement of walking or running.

The exercise device of the present invention contains braking device 88 (see FIG. 2) that acts as a flywheel, storing momentum imparted upon it during the power stroke. During the power stroke, force from the user is put into the exercise device by means of their weight, leg muscles and/or arm muscles. Braking device 88 and drive pulley 86 only spin in one direction. Braking device 88 acts as a flywheel and stores inertia in order to facilitate the start of the power stroke. The inertial momentum of braking device 88 does not affect the minimal force necessary to change the reciprocal movement of foot platforms 28, 30. It is only during the power stroke that resistance assembly 36 is engaged and that energy is imparted into braking device 88. On the return stroke of first pivoting assembly 32, or second pivoting assembly 34, drive pulley shaft 90 spins freely and does not affect the rotation of drive pulley 86 and therefore the rotation of braking device 88. Since there is very little resistance during the return stroke, and because braking device 88 is acting as a store of inertia for the power stroke, only a small amount of force is necessary to initiate the reciprocal movement of the exercise device.

FIG. 5 also shows the open access of device 10. This embodiment of the present invention is easily accessible compared to other reciprocating exercise devices. A user of the exercise device may approach from either side and from the rear. This access feature allows for the exercise device to be placed in areas not readily available to other exercise devices with restricted access. The ease of accessibility allows for more flexibility in the layout of a commercial gym containing a large number of different exercise devices. The exercise device of the present invention could be placed in positions in which entry to an enclosed exercise device would not be possible. The advantage of easy accessibility to the exercise device will also be appreciated by the home user. The home user has more choices of where to place the exercise device due to the increased access potential coupled with the compact footprint.

FIG. 5 depicts device 10 wherein the reciprocal movement of pivoting assemblies 32, 34 are dependent upon one another. In this embodiment, reciprocal swinging tube 46 is responsible for imparting a dependent movement upon pivoting assemblies 32, 34 of each first and second side of the exercise device. Reciprocal swinging tube 46 is connected to each first and second pivot sleeve 64, 66 through a respective reciprocal swinging tube stub 72, 74 (see FIG. 2) via a linkage system. For example, when first handle 14 is pushed forward, second handle 16 reciprocates backwards in an equal amount. When first pivoting assembly 32 is pushed forward, second pivoting assembly 34 reciprocates backwards in an equal amount. When first pivot sleeve 64 rotates, reciprocal swinging tube 46 causes second pivot sleeve 66 to rotate in an equal amount in an opposite direction. The effect of the dependent movement upon the user is to have an interconnected arm/foot motion that is an arm forward, opposite foot forward; just like the natural arm/foot motion of walking or running.

FIG. 5 also depicts control console 92. In an embodiment of the present invention, control console 92 may be supplied with electricity through the coupling of drive pulley 86 to an embodiment of braking device 88 that is capable of generating an electrical current. If the user gets tired of moving their arms, they can release their grip on handles 14, 16 and rest them upon the bar surrounding control console 92. Control console 92 may contain a rest bar that is capable of measuring the heart rate of the user. Additionally, control console 92 may contain common controls for the exercise device such as resistance adjustment, and pre-programmed exercise routines. Control console 92 may also display parameters used to measure exercise performance, such as distance climbed, distance traveled by foot platforms 28, 30, total power put into resistance assembly 36, stride frequency and an entire host of other common display parameters.

Figure 6:
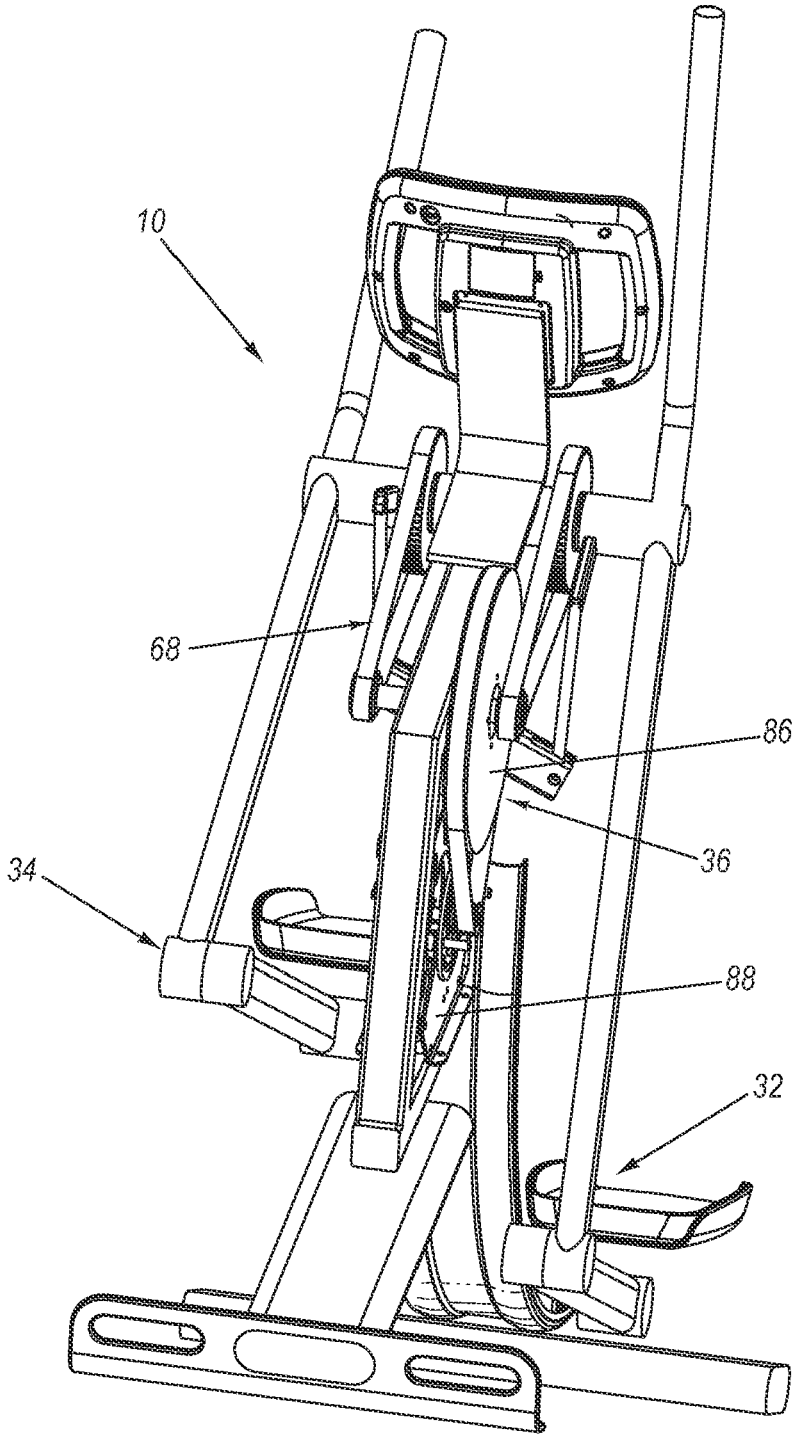
FIG. 6 is a front view of an embodiment of the exercise device of FIG. 1.

FIG. 6 is a front perspective of embodiment 10 highlighting resistance assembly 36. Resistance assembly 36 couples the movement of pivoting assemblies 32, 34 to drive pulley 86 and braking device 88. In an embodiment of the exercise device of the present invention, braking device 88 is part of resistance assembly 36.

Figure 7:
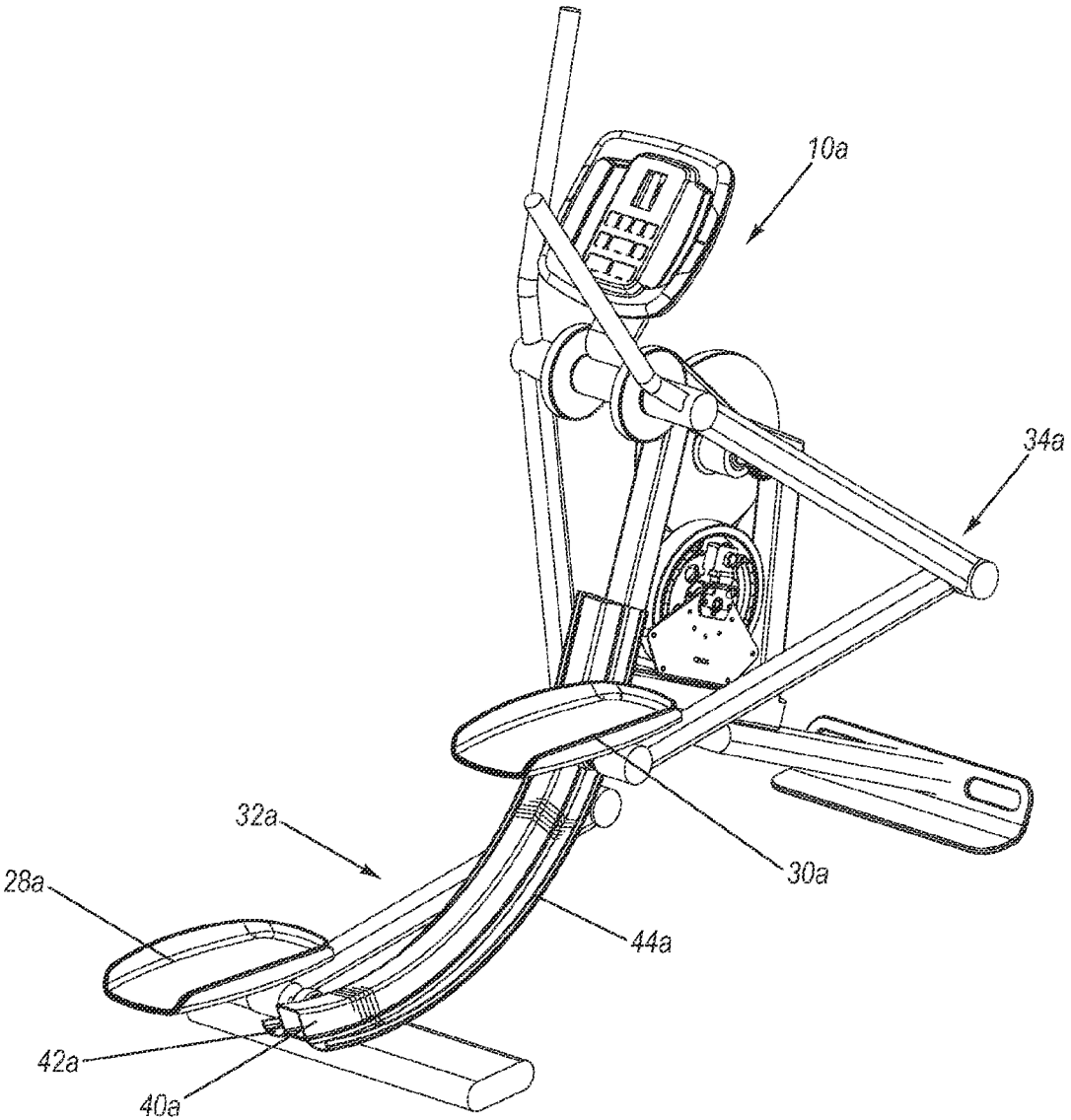
FIG. 7 is a perspective view of an alternate embodiment of an exercise device of the present invention in which the pivoting assemblies have independent movement.
Figure 8:
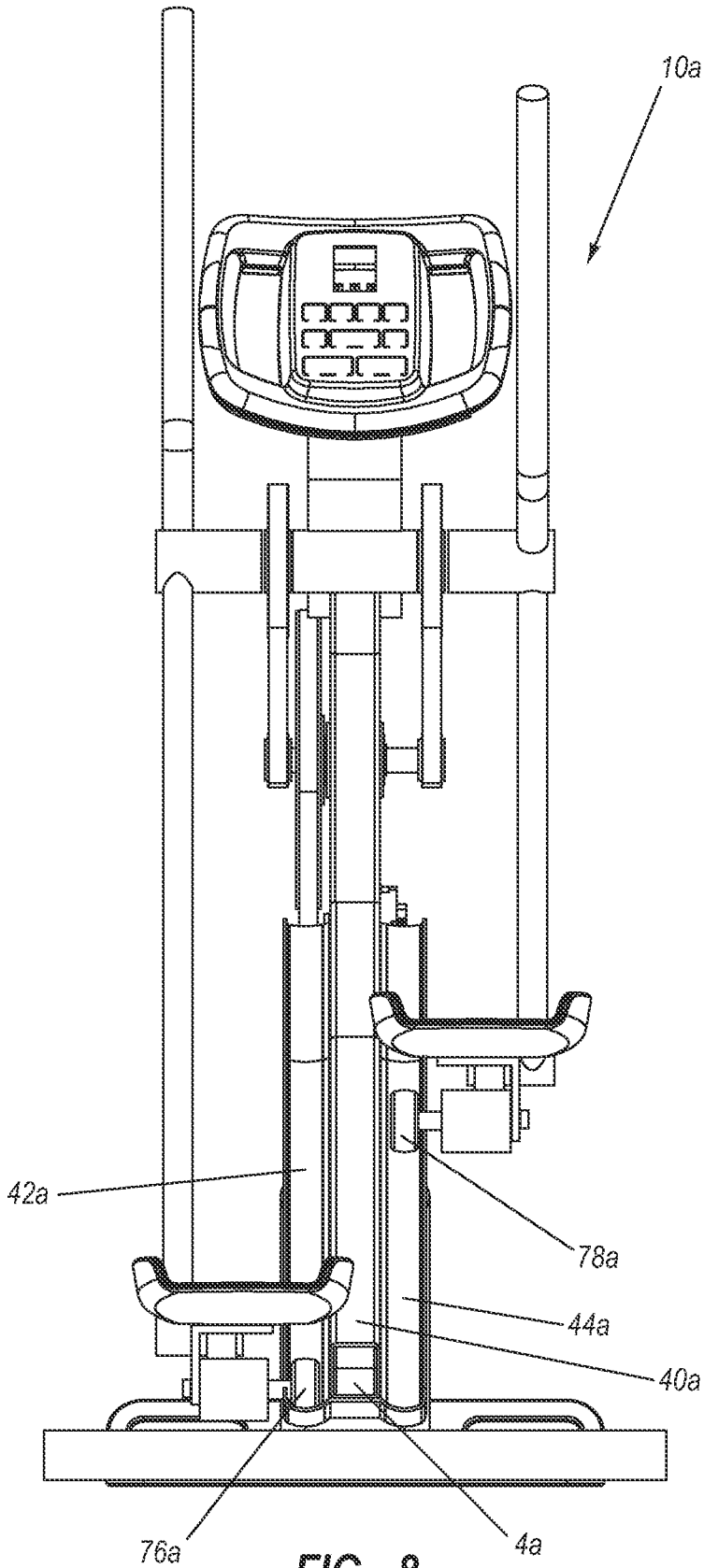
FIG. 8 is a rear view of an embodiment of the exercise device of FIG. 7.

FIGS. 7 and 8 refer to an alternate embodiment 10*a* of the exercise device. FIG. 7 is a perspective view of embodiment 10*a*. Embodiment 10*a* does not contain a reciprocal swinging tube, nor does it contain the associated linkage and the reciprocal swinging tube stubs. Pivoting assemblies 32*a*, 34*a* of embodiment 10*a* move independently of one another. In embodiment 10*a*, the user has the ability to individually determine the relative stride distance that each foot platform 28*a*, 30*a* travels along respective ramp 42*a*, 44*a*. Therefore, the user may experience different exercise techniques. For example, the user may choose to exercise only one side of their body while using embodiment 10*a*. The relation of the movement of pivoting assemblies 32*a*, 34*a* of embodiment 10*a* is left up to the discretion of the user and therefore increases the potential number and type of exercise routines available.

FIG. 8 shows a rear perspective of embodiment 10*a*. Wheels 76*a*, 78*a* that rest upon respective ramps 42*a*, 44*a* are prominently displayed in this view. In contrast to FIG. 5 which displays a rear perspective of embodiment 10*a*, the rear perspective of embodiment 10*a* displayed in FIG. 8 does not contain a reciprocal swinging tube.

Figure 9:
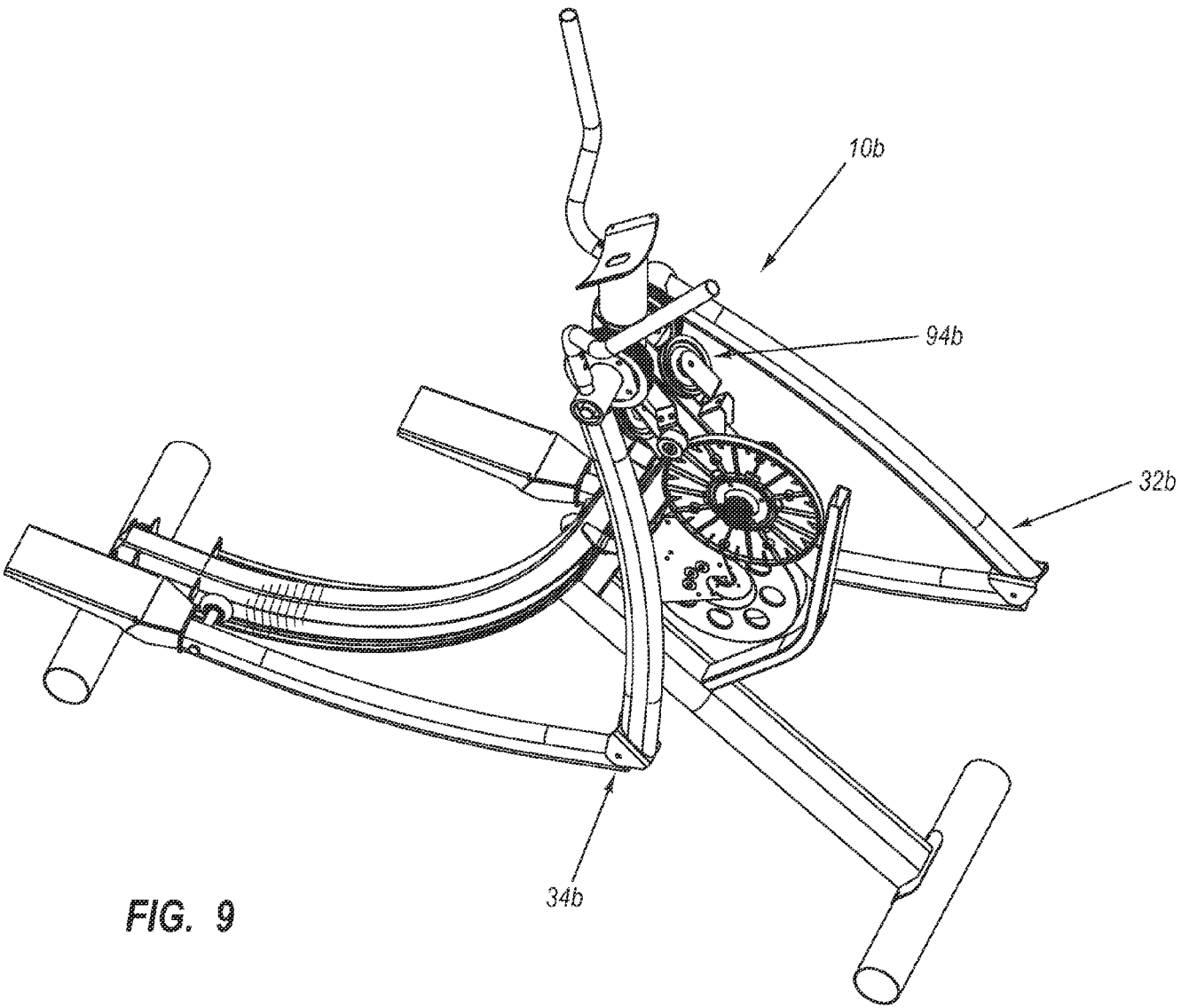
FIG. 9 is a perspective view of another embodiment of the exercise device and has a pulley and cable system that imparts a dependent, reciprocal movement upon the exercise device.

FIG. 9 depicts another alternate embodiment 10*b* of the exercise device of the present invention. Embodiment 10*b* has a pulley and cable system 94*b* that imparts a dependent, reciprocal movement upon pivoting assemblies 32*b*, 34*b*. The control console, belts and cables have been omitted from FIG. 9 for the convenience of illustrating embodiment 10.

Figure 10:
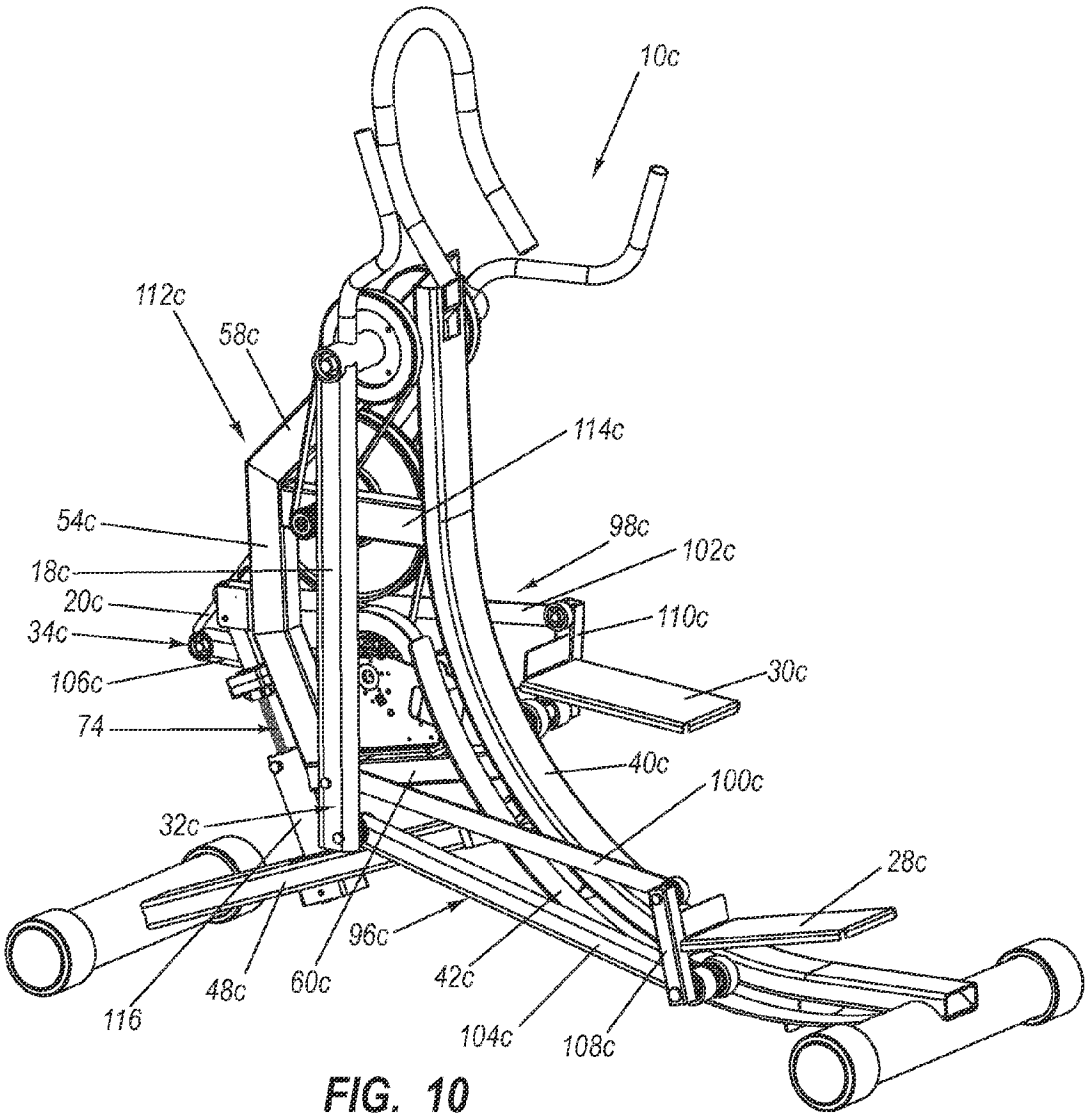
FIG. 10 is a perspective view of another alternative embodiment of the present invention having four-bar foot support members.

Embodiments 10*c* and 10*d*, as illustrated in FIGS. 10-11 and FIGS. 12-13, respectively, have four-bar foot support members. As depicted in FIG. 10 embodiment 10*c* has a first four-bar foot support member 96*c*, and a second four-bar foot support member 98*c*. Four-bar foot support members 96*c*, 98*c* are each comprised of upper members 100*c*, 102*c* and lower members 104*c*, 106*c*, respectively. First upper member 100*c* and first lower member 104*c* are substantially parallel to one another. Second upper member 102*c* and second lower member 106*c* are substantially parallel to one another. The distal ends of first upper member 100*c* and first lower member 104*c* of first four-bar foot support member 96*c* are pivotally connected to link arm 18*c*. The distal ends of second upper member 102*c* and second lower member 106*c* of second four-bar foot support member 98*c* are pivotally connected to link arm 20*c*. The proximal ends of upper members 100*c*, 102*c* and lower members 104*c*, 106*c* of respective four-bar foot support members 96*c*, 98*c* are connected to one another through a respective pedal stem 108*c*, 110*c*. Each of the top and bottom ends of pedal stems 108*c*, 110*c* are pivotally connected to respective upper members 100*c*, 102*c* and respective lower members 104*c*, 106*c* of respective four-bar foot support members 96*c*, 98*c*. Foot platforms 28*c*, 30*c* are attached to respective pedal stems 108*c*, 110*c*. Upper members 100*c*, 102*c* and lower members 104*c*, 106*c* of respective four-bar foot support members 96*c*, 98*c* have different lengths. Therefore, when foot platforms 28*c*, 30*c* travel along respective ramps 42*c*, 44*c*, the relative angle of respective pedal stems 108*c*, 110*c* and attached, respective foot platforms 28*c*, 30*c* changes. As a result of the four-bar linkage, as the user moves through the stride of exercise device 10*c* they experience a changing angle at foot platform 28*c*, 30*c* that corresponds to a more natural and ergonomically beneficial movement.

Embodiments 10*c* and 10*d*, as illustrated in FIGS. 10-11 and FIGS. 12-13, respectively, have a modified beam assembly. As depicted in FIG. 10, modified beam assembly 112*c* of embodiment 10*c*, contains a front beam member 54*c*, a top beam member 58*c*, a bottom beam member 60*c*, a ramp frame member 40*c* and an additional spanning beam member 114*c* that spans between front beam member 54*c* and ramp frame member 40*c*.

As illustrated in FIG. 10, embodiment 10*c* also has independent movement of pivoting assemblies 32*c*, 34*c*.

Figure 11:
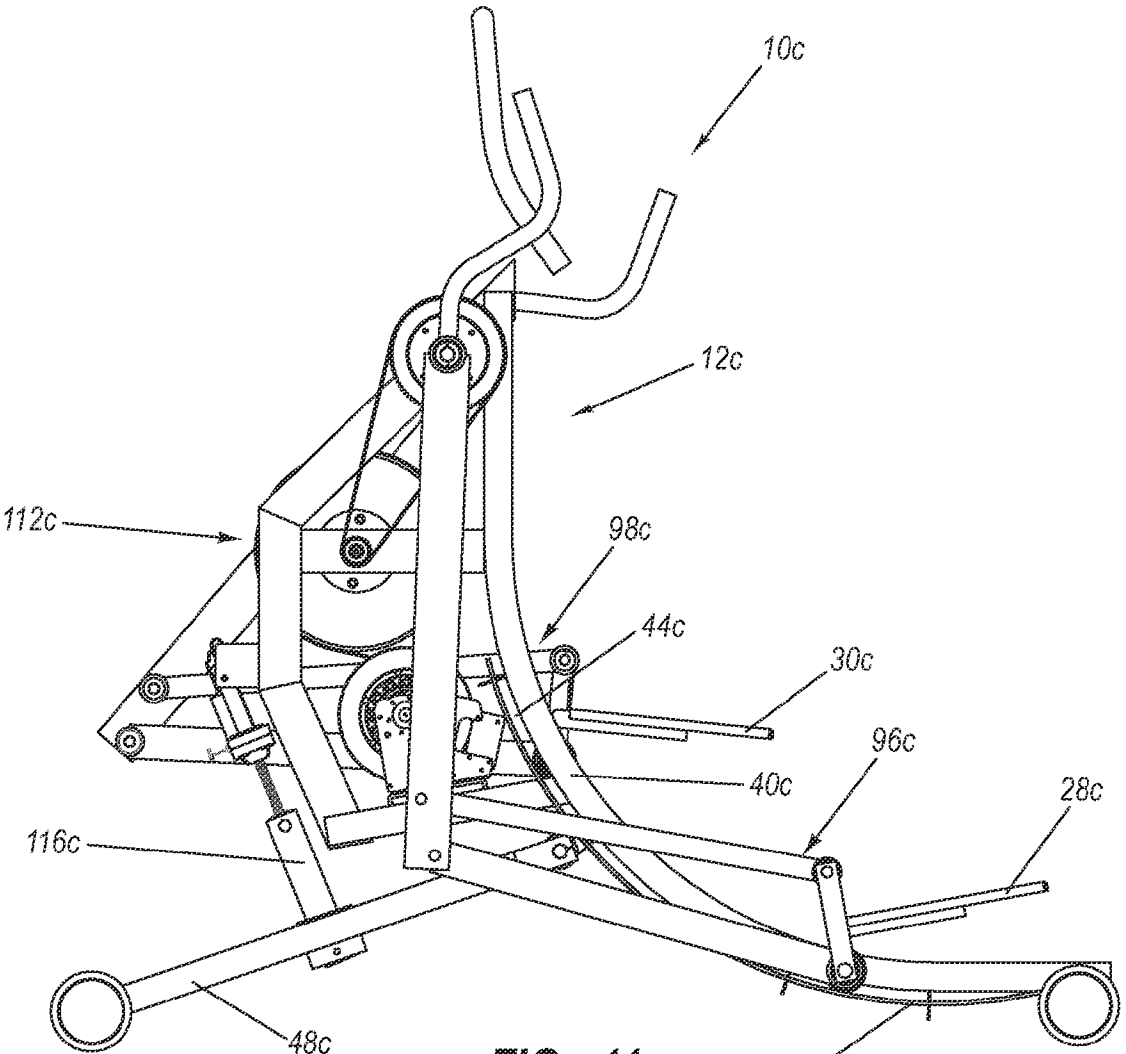
FIG. 11 is a side view of the embodiment of FIG. 10 of the present invention showing the incline adjustment assembly and showing the change in angle of the foot platform caused by the four bar linkage.

Embodiments 10*c* and 10*d*, as illustrated in FIGS. 10-11 and FIGS. 12-13, respectively, have an adjustable screw motor that is capable of adjusting the incline of the framework. As illustrated in FIG. 11, in embodiment 10*c*, the bottom end of adjustable screw motor 116*c* is mounted to leg member 48*c*. The opposing top end is mounted to front beam 54*c*. The proximal end of leg member 48*c* is pivotally attached to ramp frame member 40*c* of modified beam assembly 112*c*. Thus, by adjusting the extension of adjustable screw motor 116*c*, the angle formed by ramp frame member 40*c* and leg member 48*c* may be adjusted, thereby either inclining or declining ramps 42*c*, 44*c*, ramp frame member 40*c* and modified beam assembly 112*c*.

Figure 22:
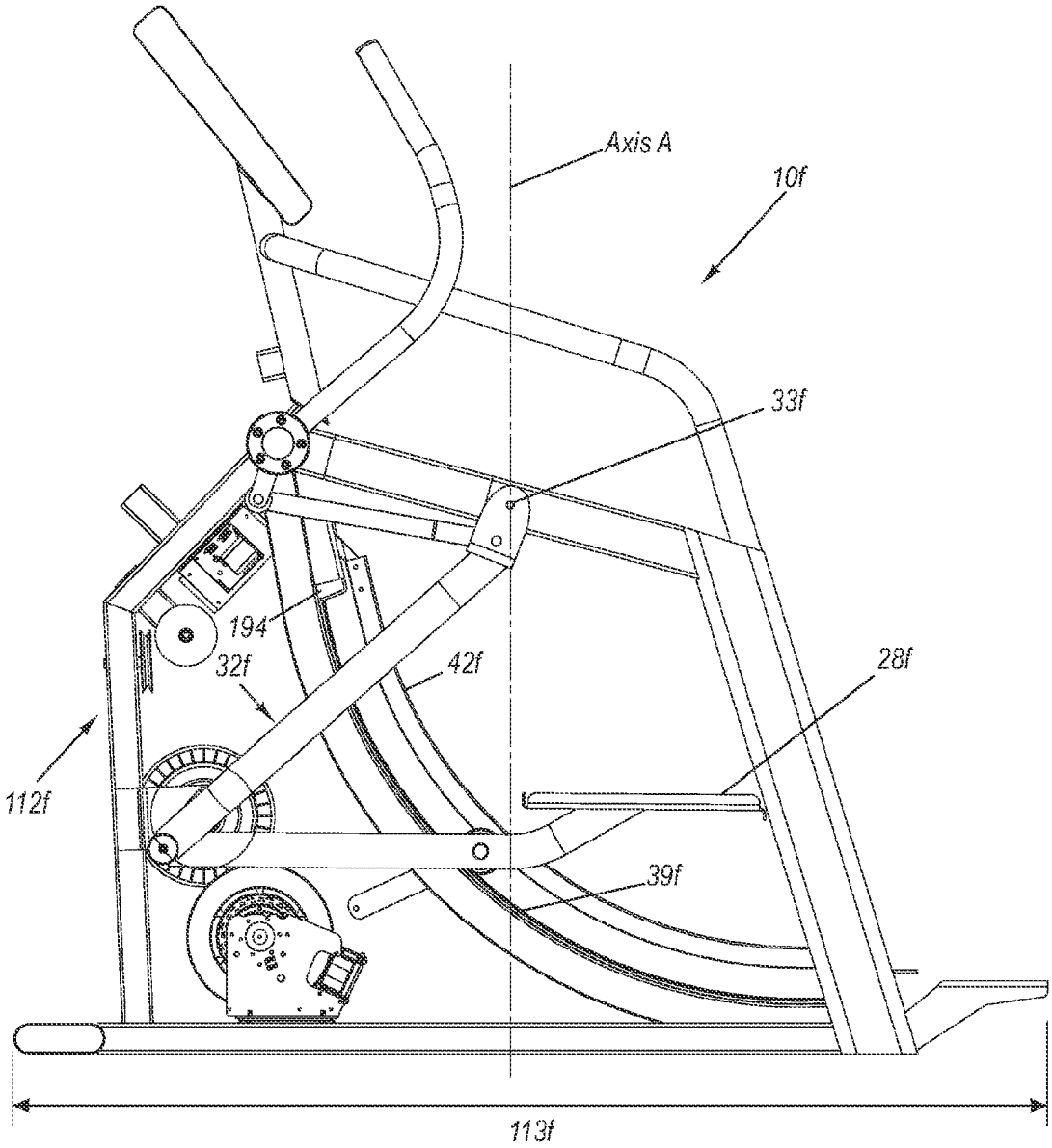
FIGS. 22-27 feature an embodiment of an exercise device that is similar to the exercise device of FIGS. 14-21. Although the cables of the resistance assembly are not shown in FIGS. 22-27, the cables and other components of the resistance assembly described with respect to FIGS. 20-21 (and FIGS. 14-19) can be used in the embodiment of FIGS. 22-27.
Figure 24:
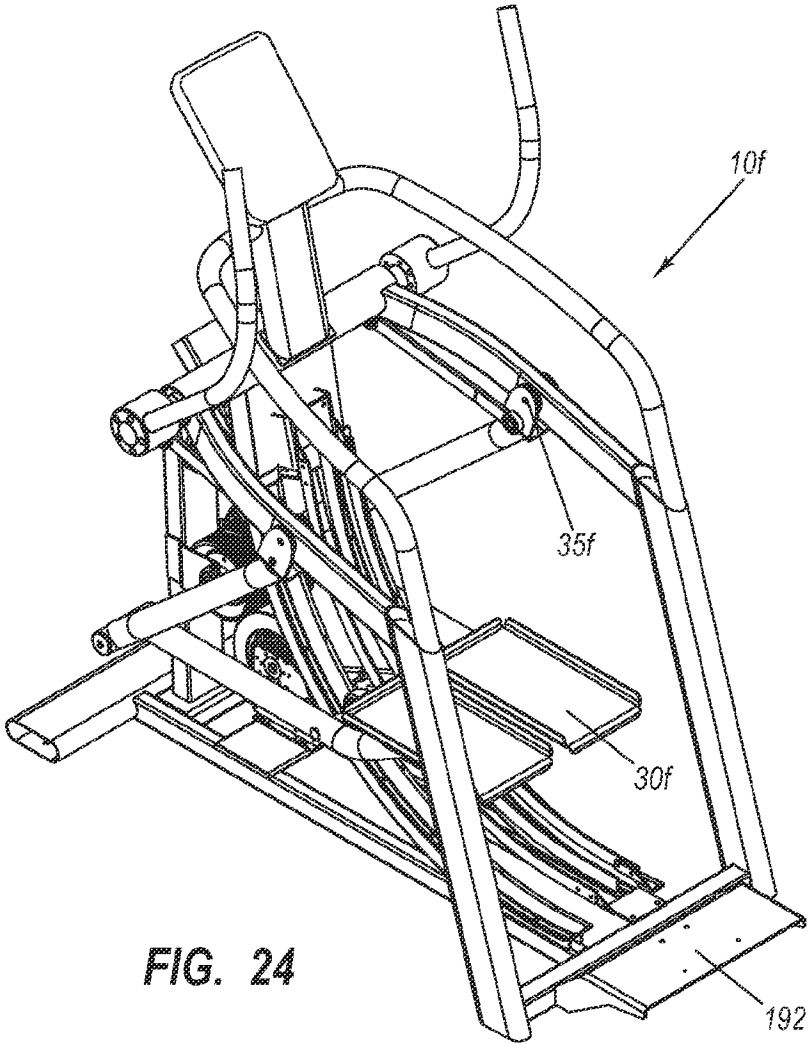
Figure 23:
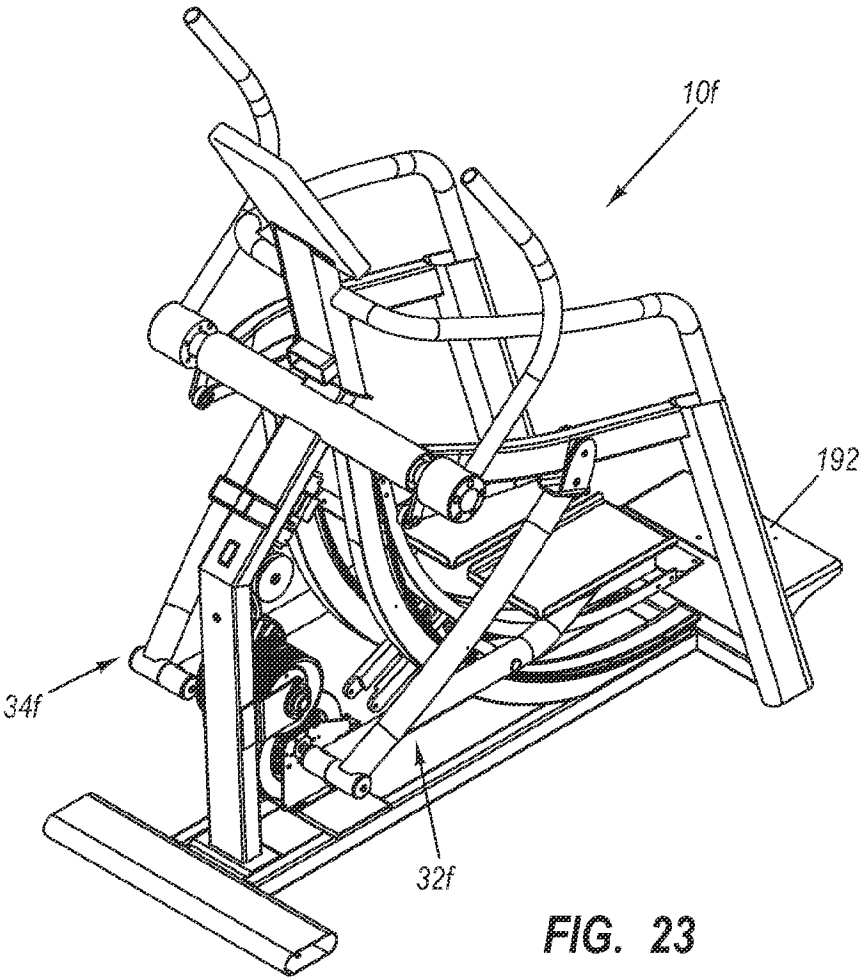
Figure 27:
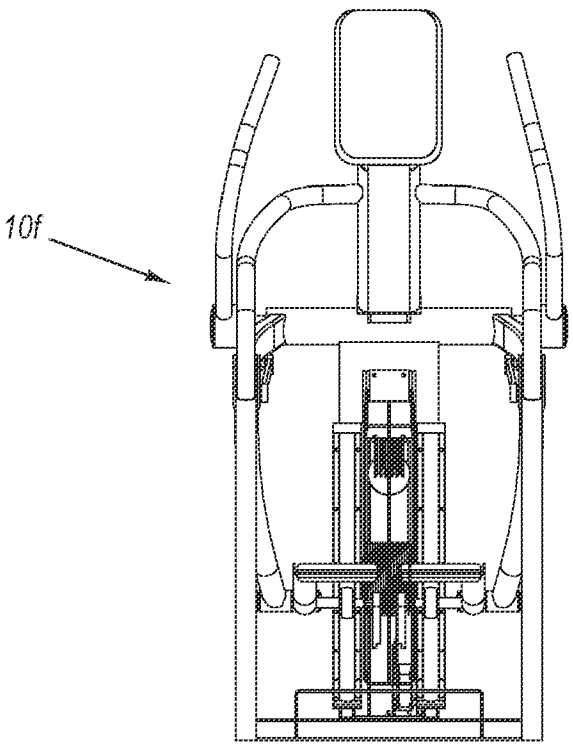
Figure 26:
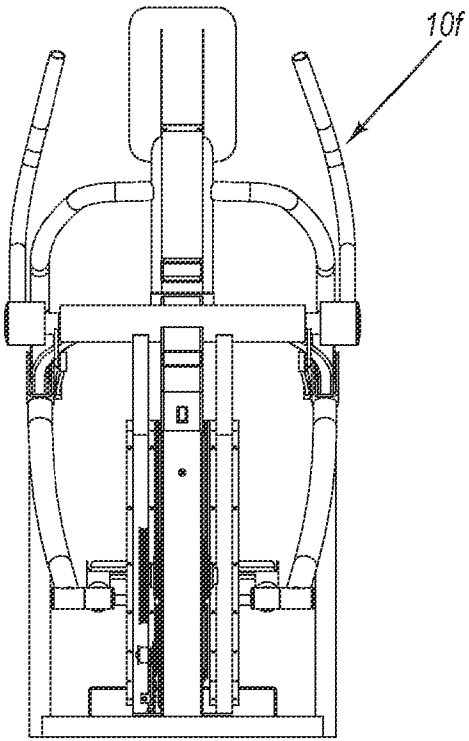
Figure 25:
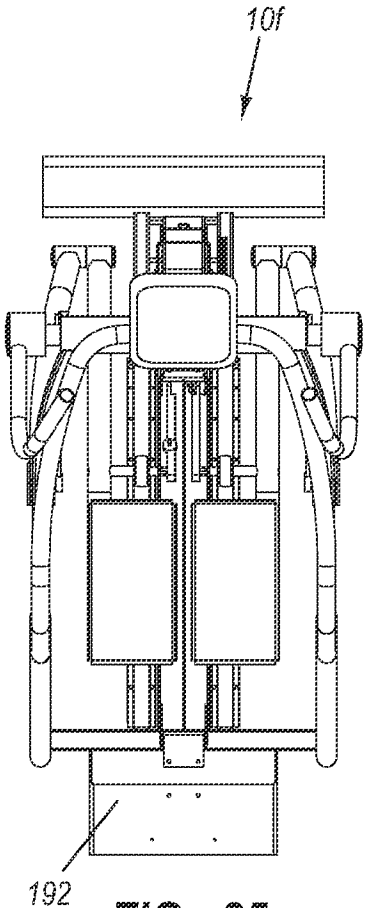

The neutral position of the present exercise device is the position in which the foot platforms are disposed laterally adjacent to one another. When the present exercise device is in the neutral position, the user's body is in the neutral body position (an example of another embodiment of an exercise device in the neutral position is shown in FIG. 22). In embodiments 10*c* and 10*d*, and as illustrated in FIG. 11 depicting embodiment 10*c*, the user's body may experience a variety of different positions depending upon the incline of modified beam assembly 112*c*, ramp frame member 40*c* and ramps 42*c*, 44*c* relative to the support surface. As the incline of modified beam assembly 112*c*, ramp frame member 40*c* and ramps 42*c*, 44*c* changes, the neutral body position of the user changes.

Different body positions impart different characteristics to the exercise movement of the present exercise device. Using embodiment 10*c* as depicted in FIG. 11 as an example, if a user wants to place more of a burden on their arms, they can adjust the incline of modified beam assembly 112*c*, ramp frame member 40*c* and ramps 42*c*, 44*c* to have a more horizontal aspect by decreasing the length of adjustable screw motor 116*c*. Thus, the user becomes more angled towards the front end of the exercise device and increases the amount of weight on their arms as they move through the striding motion. If the user wants to place more of a burden on their legs, the user can increase the length of adjustable screw motor 116*c*. This increases the incline of modified beam assembly 112*c*, ramp frame member 40*c* and ramps 42*c*, 44*c*, causing a commensurate increase in the vertical aspect of the stride and body position of the user, thus placing more of the user's weight onto their legs.

FIG. 11 portrays another perspective of embodiment 10*c*, highlighting the changing angle of foot platforms 28*c*, 30*c* due to four-bar foot support members 96*c* and 98*c*. This changing angle results in a more natural and ergonomically beneficial movement. FIG. 11 also highlights adjustable screw motor 116*c* of framework 12*c*. Adjustable screw 116*c* is an example of means for adjusting the neutral body position of the user of the exercise device with respect to a support surface.

Figure 12:
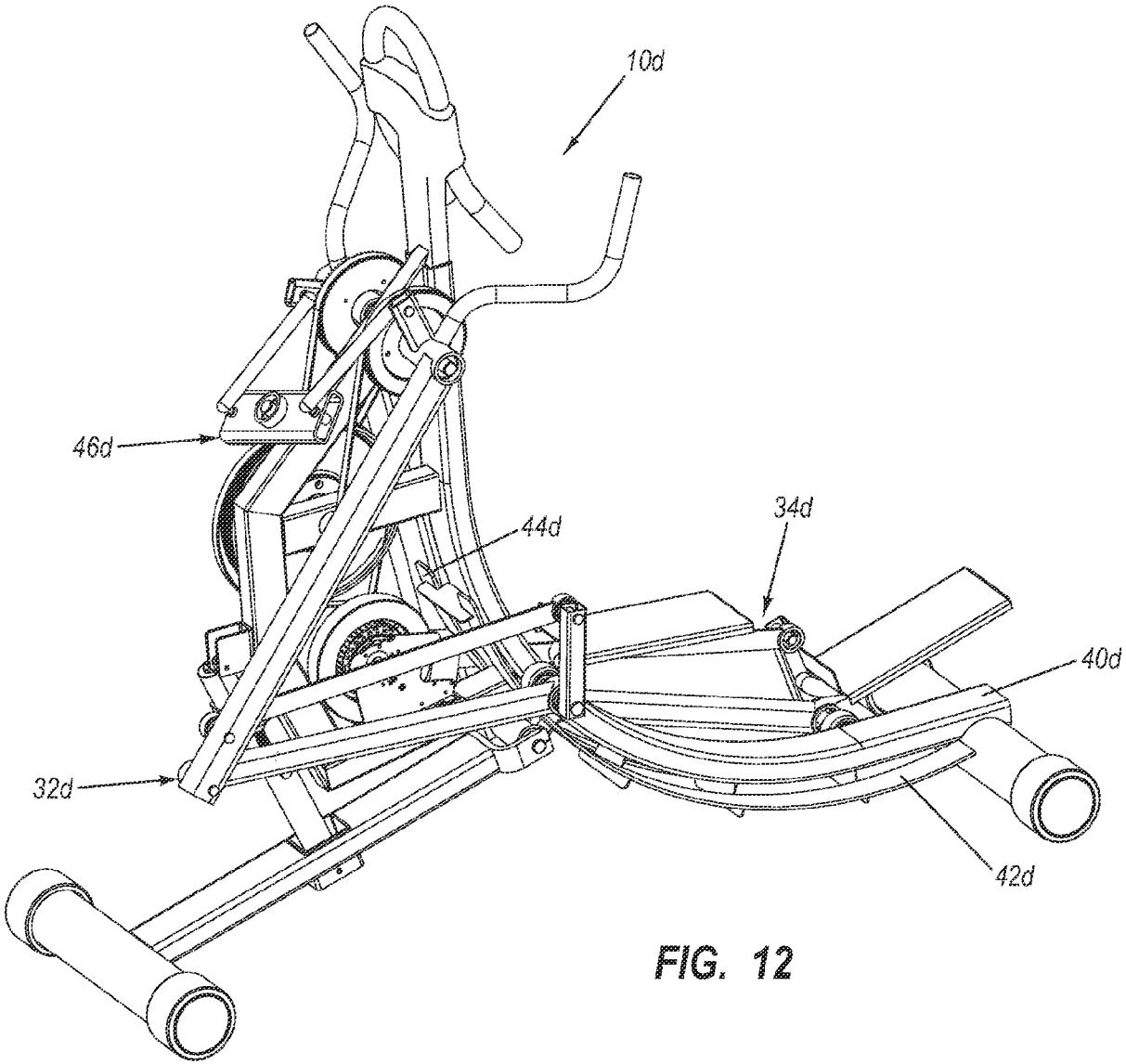
FIG. 12 is a perspective view of an alternative embodiment of the exercise device that has dependent movement.
Figure 13:
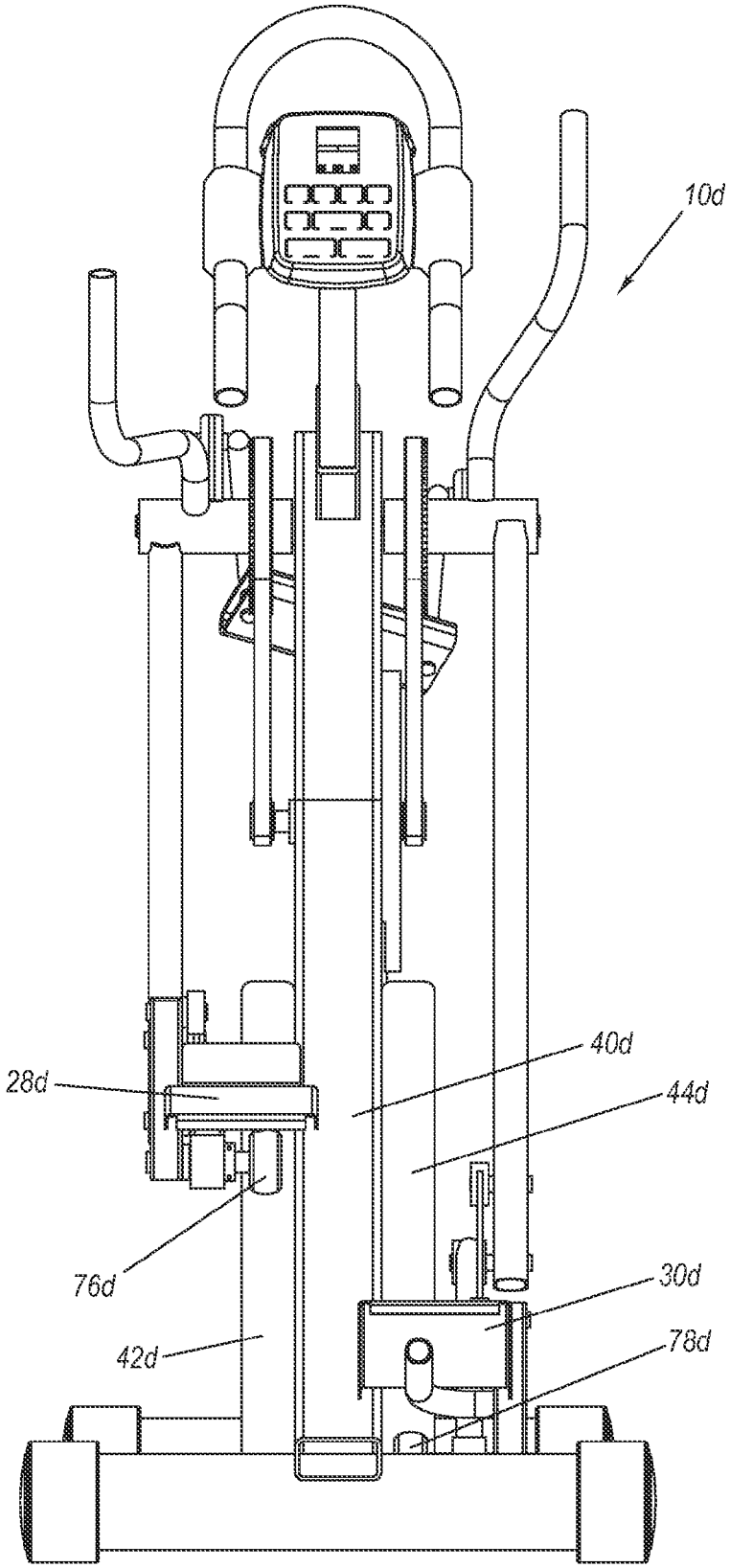
FIG. 13 is a rear view of the embodiment of FIG. 12.

FIGS. 12 and 13 illustrate embodiment 10*d*. In FIG. 12, the perspective view of embodiment 10*d* shows that the dependent, reciprocal movement of pivoting assemblies 32*d*, 34*d* on each side of embodiment 10*d* is caused by reciprocal swinging tube 46*d*.

FIG. 13 shows a rear perspective of embodiment 10*d*, highlighting wheels 76*d*, 78*d*, ramps 42*d*, 44*d*, ramp frame member 40*d* and foot platforms 28*d*, 30*d*.

Figure 14:
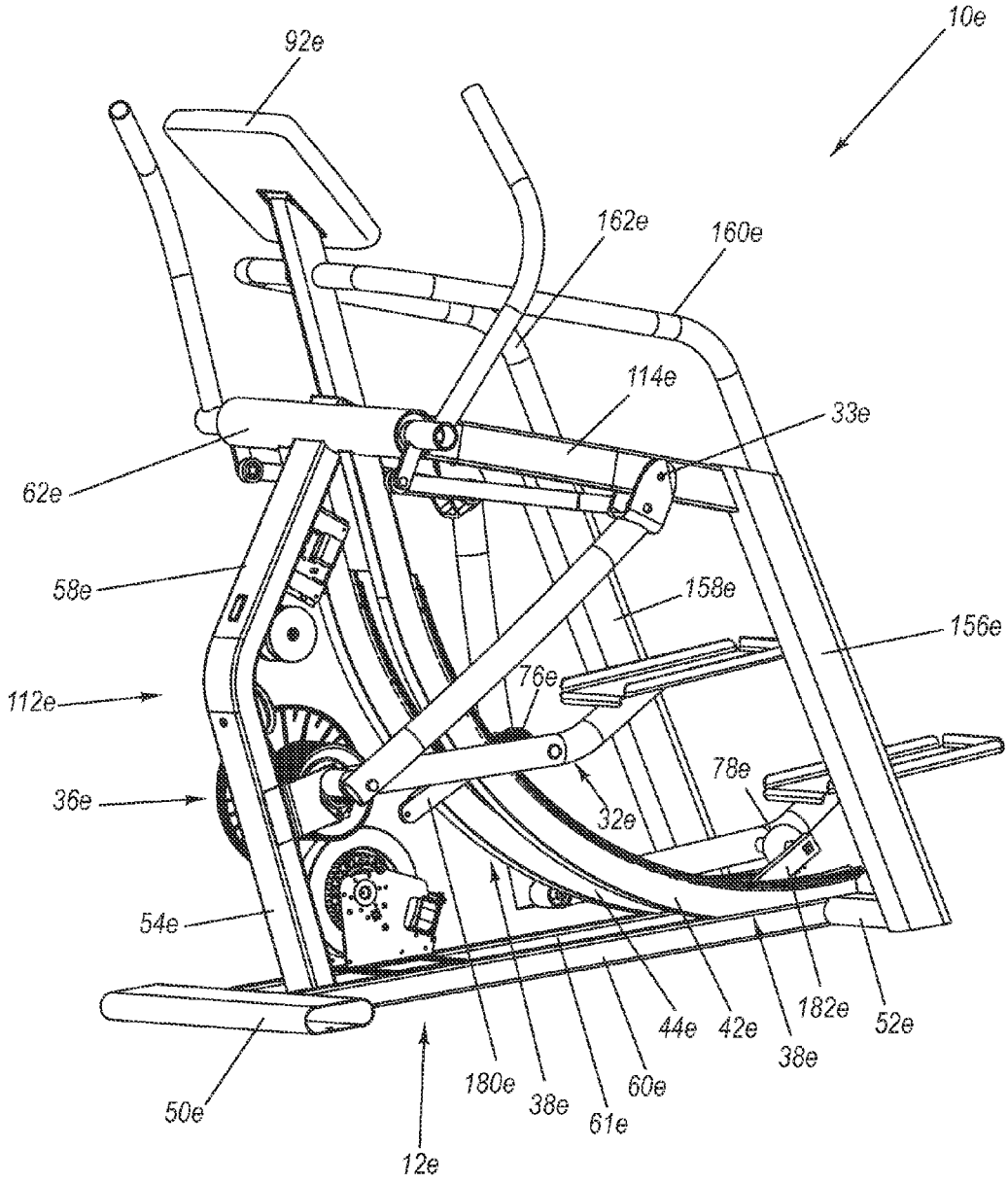
FIG. 14 is a perspective view of another embodiment of the present invention having a shortened pivot assembly.
Figure 15:
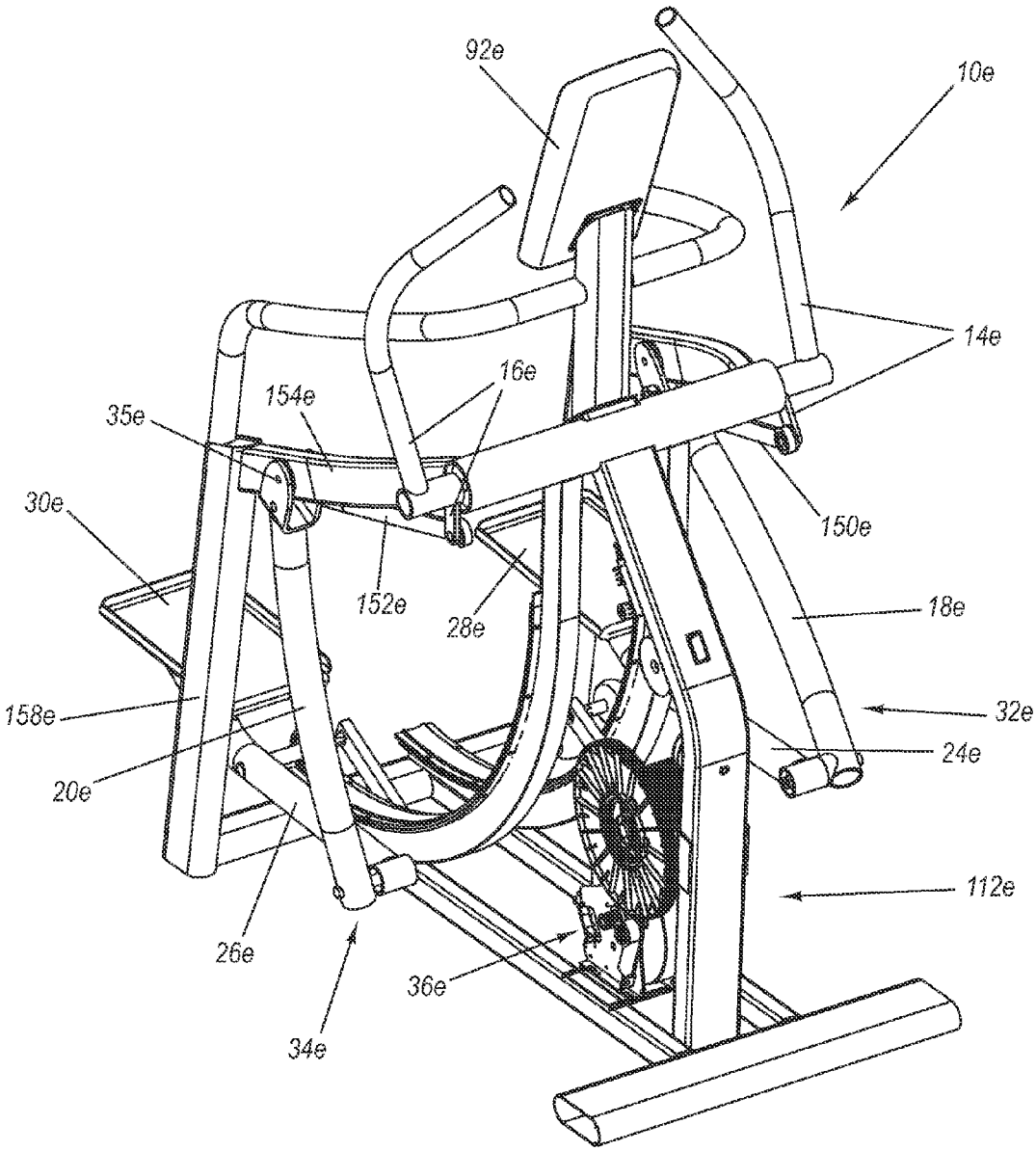
FIG. 15 is another perspective view of the embodiment of FIG. 14 showing the shortened pivot assembly.

Another embodiment of an exercise device 10*e* of the present invention, as illustrated in FIGS. 14-21, has shortened pivoting assemblies 32*e*, 34*e*, pivotally coupled in a strategic location to a framework 12*e*, providing a compact, useful exercise device. As depicted in FIGS. 14-15, device 10*e* has shortened, reciprocating pivoting assemblies 32*e*, 34*e* secured to side support members 114*e*, 154*e*. As a result of the shortened pivoting assemblies 32*e*, 34*e*, the invention contains a reduced footprint while maintaining the various benefits of similar embodiments.

Device 10*e* comprises a framework 12*e*, as illustrated in FIGS. 14-15, that comprises a beam assembly 112*e*, a first stabilizer member 50*e* attached to beam assembly 112*e*, a ramp assembly 38*e* attached to beam assembly 112*e*, and a pair of curved, elongated gripping rods 160*e*,162*e* attached to beam assembly 112*e* for grasping by a user. Ramp assembly 38*e* comprises a first ramp spaced apart from a second ramp. Additionally, the framework may be selectively inclined, e.g., through the use of an adjustable screw motor inserted in between parts of the framework, such as discussed above.

As depicted in FIGS. 14-15, beam assembly 112*e* of embodiment 10*e* comprises a front beam member 54*e*, a top beam member 58*e* connected to front beam member 54*e*, a pair of bottom beam members 60*e*, 61*e* connected to front beam member 54*e*, a rear stabilizer member 52*e* connected to bottom beam members 60*e*, 61*e*, a pair of spaced apart rear support members, 156*e*, 158*e* connected to rear stabilizer member 52*e*, a pair of spaced apart side support members 114*e*, 154*e* connected to respective spaced apart rear support members 156*e*, 158*e* and a main pivot shaft 62*e*, which is connected to top beam member 58*e* and to side support members 114*e*, 154*e*. A ramp assembly 38*e*, comprising first and second ramps 42*e*, 44*e* with a space therebetween, is connected to beam assembly 112*e* by being connected to main pivot shaft 62*e* and bottom beam members 60*e*, 61*e* and/or rear stabilizer member 52*e*. Thus, the addition of the side support members 114*e*, 154*e* attached to the main pivot shaft 62*e* as well as the rear support members 156*e*, 158*e* allow for a smaller footprint for the invention.

As depicted in FIGS. 14-15, ramp assembly 38*e* of embodiment 10*e* comprises a first ramp 42*e*, and a second ramp 44*e*, both of the first and second ramps being connected to main pivot shaft 62*e* and bottom beam members 60*e*, 61*e* and/or rear stabilizer member 52*e*. The free end of each foot support member 24*e*, 26*e*, is freely movable, has a wheel thereon for movement along a respective ramp and can be lifted off each respective ramp 42*e*, 44*e*. As a result of the use of freely movable ends of each foot support member 24*e*, 26*e*, the path that respective foot platforms 28*e*, 30*e* travel is defined by the shape of the underlying ramps 42*e*, 44*e*, respectively, as discussed above with respect to previous embodiments. The ramp assembly 38*e* may comprise of a variety of configurations and shapes. The configurations of ramps 42*e*, 44*e* may vary in length. The shape of ramps 42*e*, 44*e* may be arced as shown. The shape of ramps 42*e*, 44*e* may be curved, straight, linear, or other possible shapes.

The proximal ends of respective foot support members 24*e*, 26*e* are attached to respective foot platforms 28*e*, 30*e*, so that, in one embodiment, the angle of foot platform 28*e*, 30*e* relative to the support surface does not significantly change throughout the striding motion.

Figure 19:
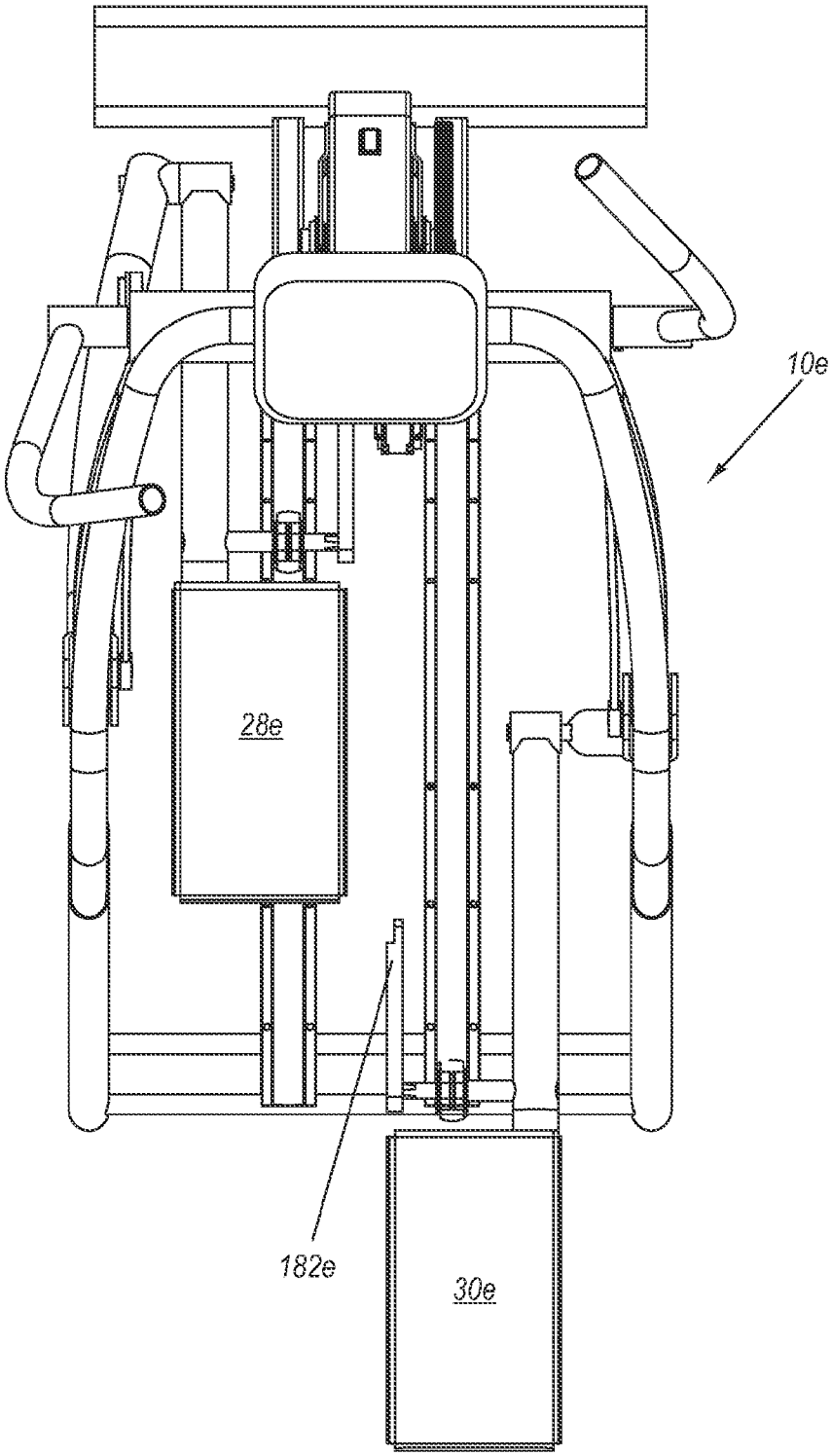
FIG. 19 is top view of the embodiment of the exercise device of FIG. 14.

FIG. 19 shows a top perspective view that depicts the small footprint of the exercise device 10*e*. Since framework 12*e* is substantially enclosed between first pivoting assembly 32*e* and second pivoting assembly 34*e*, the overall footprint of the exercise device 10*e* is small. One advantage of the current exercise device 10*e* is that the size, and hence the footprint on the support surface, is substantially contained within the moving parts of the device 10*e*. This decreased footprint offers substantial benefits to both the home user and the commercial user. Exercise device 10*e* takes up less space in the home of the user as well as increasing the amount of floor space available in a commercial gym that offers exercise device 10*e* instead of other devices. The amount of movement that the user experiences is very large compared to the small lengthwise footprint of exercise device 10*e*.

As depicted in FIGS. 14-15, a first pivoting assembly 32*e*, of exercise device 10*e* comprises a first link arm 18*e* pivotally coupled to framework 12*e* and first foot support member 24*e* pivotally coupled to first link arm 18*e*. Second link arm 20*e* is pivotally coupled to framework 10*e* and second foot support member 26*e* is pivotally coupled to second link arm 20*e*, thereby forming a second pivoting assembly 34*e*. Pivoting assemblies 32*e*, 34*e* further comprise first foot platform 28*e* for first pivoting assembly 32*e* and second foot platform 30*e* for second pivoting assembly 34*e*. Pivoting assemblies 32*e*, 34*e* further comprise, respectively, a first connecting arm 150*e* connecting to first link arm 18*e* and a first handle assembly 14*e* for first pivoting assembly 32*e* and a second connecting arm 152*e* connecting to second link arm 20*e* and a second handle assembly 16*e* for second pivoting assembly 34*e*. Each handle assembly comprises a handle for gripping by a user and a stub portion connecting to a respective connecting arm 150*e*, 152*e*.

Pivoting assemblies 32*e*, 34*e* move in a convenient, back and forth reciprocating pattern. Resistance to the movement of pivoting assemblies 32*e*, 34*e*, comes from a resistance assembly 36*e* coupled to pivoting assemblies 32*e*, 34*e*.

Pivoting assemblies 32*e*, 34*e* further comprises respective wheels 76*e*, 78*e* coupled to respective foot support members 24*e*, 26*e*. Each wheel 76*e* movably couples the end of the foot support member to a respective ramp 42*e*, 44*e* of the ramp assembly 38*e* by moving along the ramp assembly 38*e*, each of said wheels being spaced apart from each other and being capable of movably rolling upon respective ramps of the ramp assembly 38*e*.

Spaced apart foot support members 24*e*, 26*e* each have an end that is free, as discussed above with respect to previously described embodiments. Reciprocating, back and forth displacement of the free end of each foot support member 24*e*, 26*e* substantially corresponds to the curved shape of the respective ramps 42*e*, 44*e* of ramp assembly 38*e*. Extending from each of the respective foot support members 24*e*, 26*e* is a connector 180*e*, 182*e* (see FIGS. 14, 16) configured to be coupled to opposing ends of a cable (see FIGS. 20-21) such that the movement of the wheel 76*e* of foot support member 24*e* along the first ramp 42*e* is linked to movement of the wheel 78*e* of foot support member 26*e* along the second ramp 44*e*.

FIGS. 14-18 also depicts control console 92*e*. In an embodiment of the present invention, control console 92*e* may be supplied with electricity and contain common controls for the exercise device such as resistance adjustment, and pre-programmed exercise routines. Control console 92*e* may also display parameters used to measure exercise performance, such as distance climbed, distance traveled by foot platforms 28*e*, 30*e*, total power put into resistance assembly 36*e*, stride frequency and an entire host of other common display parameters. Circuit board 190*e* links communication and instructions between control console 92*e* and resistance assembly 36*e*. Console 92*e* may be powered, for example, from electricity generated by use of the device through the configuration of the resistance assembly.

Figure 16:
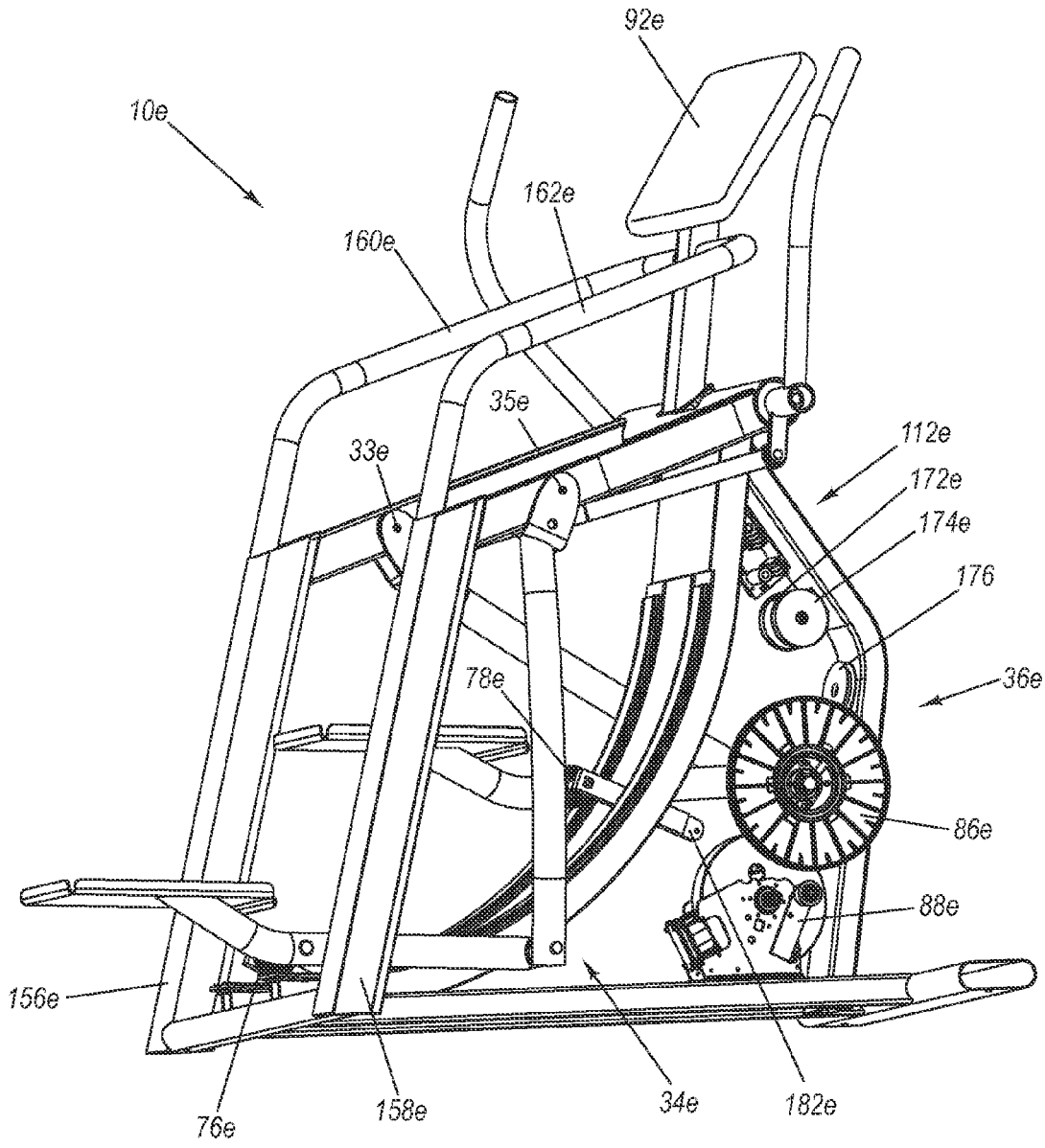
FIG. 16 is a side perspective view of the exercise device of FIG. 14 showing the resistance assembly.
Figure 17:
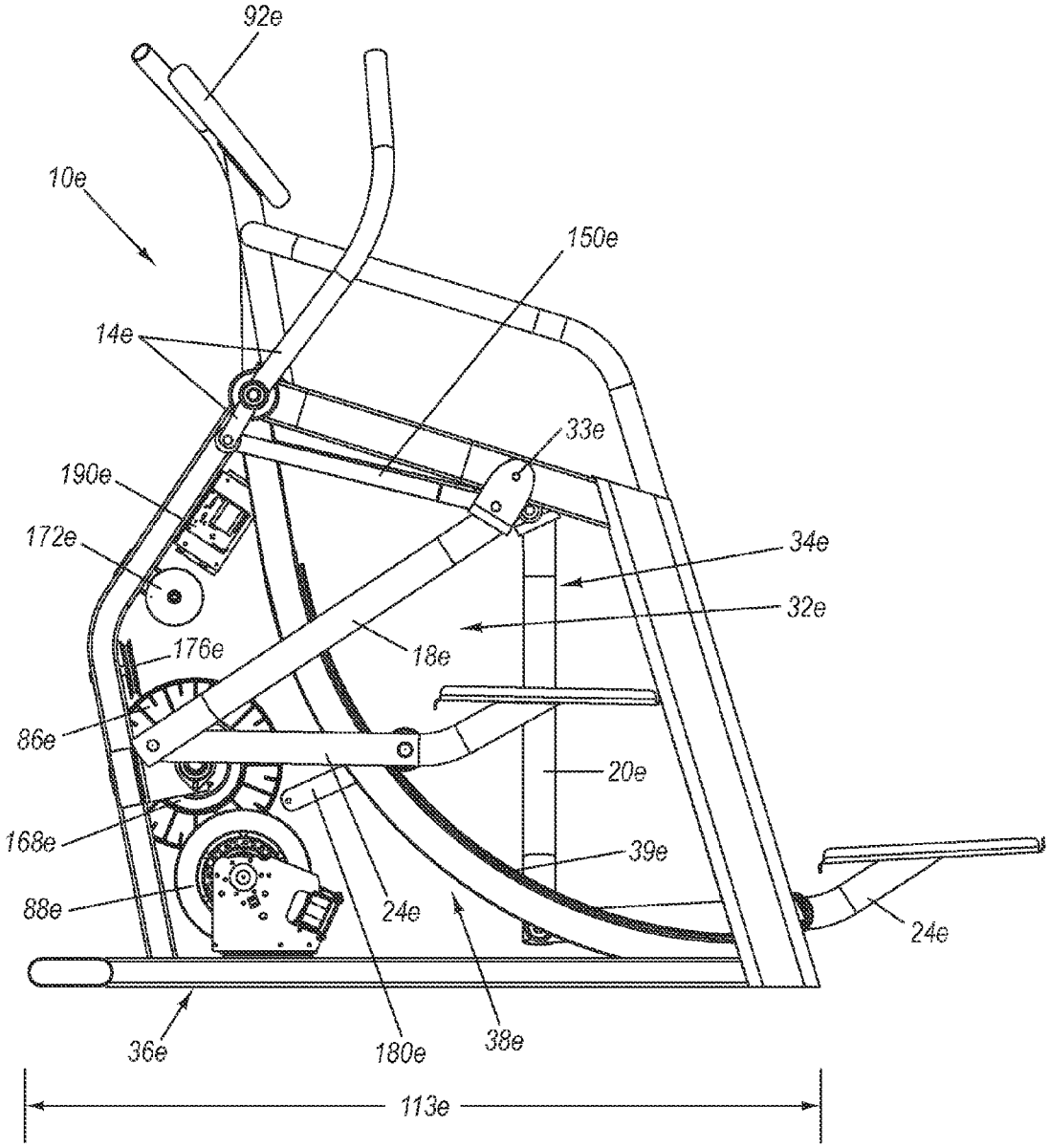
FIG. 17 is side view of the embodiment of the exercise device of FIG. 14.

As depicted in FIGS. 16 and 17, the rotation and movement of pivoting assemblies 32*e*, 34*e* of embodiment 10*e* occurs substantially within the overall footprint of the exercise device 10*e*. The pivot points 33*e*, 35*e* of pivoting assemblies 32*e*, 34*e* are substantially positioned over a central portion of ramp assembly 38*e*, as shown in FIG. 17, resulting in the pivot assembly remaining substantially within the framework during use. The movement and rotation of pivoting assemblies 32*e*, 34*e* substantially remaining within the framework 12*e* during use provides for an efficient, small footprint.

As discussed above, the user can move in a reciprocating manner through a variety of stride paths with very small, incremental movements (e.g., 1 inch) or very large movements (e.g., 3 feet or more), as opposed to elliptical devices that have a predefined and immutable path. In the present invention, the user's stride length is not restricted by a fixed rotation of a crank, gear or other device as is found on elliptical devices.

The wheels 76*e*, 78*e* of pivoting assemblies 32*e*, 34*e* travel along the lengths of respective ramps. The ramp length is the distance between the first and second opposing (i.e., upper and lower) ends of the ramps 42*e*, 44*e*. In the case of curved ramps 42*e*, 44*e*, the ramp length is the arc length defined between the opposing ends of the ramps. The "arc length" is the distance along the curved line making up the arc of a curved ramp (i.e., not the distance along a straight line extending between the ends of a curved ramp).

In one embodiment, device 10*e* features a ramp length of at least about 30 inches. In another embodiment, the ramp length of device 10*e* is at least about 35 inches. In another embodiment, the ramp length of device 10*e* is at least about 40 inches. In yet another embodiment, the ramp length of device 10*e* is at least about 45 inches (e.g., about 46 inches, etc.).

Each pivoting assembly 32*e*, 34*e* is movably mounted on the at least one ramp by having a portion of each of the pivoting assemblies 32*e*, 34*e*, e.g., a respective wheel 76*e*, 78*e*, movably mounted on a respective ramp 42*e*, 44*e*. The maximum stride length of device 10*e* is defined as the maximum distance that each wheel 76*e*, 78*e*, moves along a respective ramp 42*e*, 44*e*. In the case of curved ramps 42*e*, 44*e*, the maximum stride length is the maximum arc length traveled by wheels 76*e*, 78*e* along a respective ramp 42*e*, 44*e*.

In one embodiment, device 10*e* features a maximum stride length of at least about 30 inches. In another embodiment, the maximum stride length of device 10*e* is at least about 35 inches. In another embodiment, the maximum stride length of device 10*e* is at least about 40 inches. In yet another embodiment, the maximum stride length of device 10*e* is at least about 44 inches.

Such potentially useable lengths, e.g., 44 inches, are useful for both beginning and serious exercisers desiring a long maximum stride length in order to increase athletic performance, longer strides in various athletic events, and flexibility of legs and joints, whereas such lengths are not available with certain other devices, thereby providing an improvement in potential athletic conditioning, flexibility and performance. Such lengths provide an advantage over previous devices because a user can reach a full potential stride length, thereby providing a maximum stretching and striding benefit to a user.

Embodiment 10*e* allows a long potential maximum stride length relative to the footprint length 113*e* of the framework 12*e* of the exercise device 10*e*, thereby maximizing exercise benefit achieved to workout space used. The footprint length 113*e* is defined as the longest dimension of the framework 12*e* measured along a support surface, e.g., the floor.

In one embodiment, the maximum stride length may be as much as at least 75% of the footprint length 113*e* of the framework 12*e* of the exercise device 10*e*. The small overall footprint and movement of the pivot assemblies 32*e*, 34*e* takes up a smaller amount of space than bulkier exercise devices, therefore allowing a greater number of the current exercise devices to be used commercially in a gym or a more convenient location in a user's home.

In one embodiment of the present invention, the maximum stride length is at least about 25% of the footprint length 113*e* of the framework 12*e* of the exercise device 10*e*. In another embodiment, the maximum stride length is at least 35% of the footprint length 113*e* of the framework 12*e* of the exercise device 10*e*. In another embodiment, the maximum stride length is at least 45% of the footprint length 113*e* of the framework 12*e* of the exercise device 10*e*. In another embodiment, the maximum stride length is at least 55% of the footprint length 113*e* of the framework 12*e* of the exercise device 10*e*. In another embodiment, the maximum stride length is at least 65% of the footprint length 113*e* of the framework 12*e* of the exercise device 10*e*. In yet another embodiment, the maximum stride length is at least 75% of the footprint length 113*e* of the framework 12*e* of the exercise device 10*e*.

The long stride lengths of the present invention are available, as opposed to smaller stride lengths, because the invention is designed to enable long, extended movements and because the invention is designed to provide options for the user of the device. Rather than being limited to a relatively small stride length, the user of the present invention can selectively move a small distance or a large striding distance designed to stretch and move the user's limbs as short or as long as desired by the user. By employing a resistance assembly comprising the cabling of the present invention, as opposed to a fixed crank, as employed with elliptical machines, the user of the present invention can selectively move the user's legs a large distance or a small distance. A fix crank requires typical elliptical exercisers to move in a fixed pattern, while the cable resistance system of the present invention enables users to select the distance they desire for a maximum stride length.

As further illustrated in FIGS. 16 and 17, the pivot points 33*e*, 35*e* of pivoting assemblies 32*e*, 34*e* are substantially positioned over a central portion 39*e* of ramp assembly 38*e*, resulting in the pivot assemblies 32*e*, 34*e* remaining substantially within the footprint length 113*e* of the framework 12*e* during use. As a result of the configuration shown in FIGS. 14-22, the wheels of respective pivoting assemblies 32*e*, 34*e* move along the length of respective ramps of ramp assembly 38*e*, providing a long length of travel while the overall device 10*e* nevertheless has an efficient, small footprint. Thus, device 10*e* features pivot points 33*e*, 35*e* positioned over a central portion 39*e* of ramp assembly 38*e*, thereby providing a long length of travel for the wheels of assemblies 32*e*, 34*e*. In one embodiment, when pivoting assemblies 32*e*, 34*e* are located in the neutral position such that the assemblies 32*e*, 34*e* are aligned when viewed from a side view, pedals 28*f*, 30*f* are located below and behind pivot points 33*e*, 35*e*. Thus, device 10*e* features pivot points 33*e*, 35*e*positioned over a central portion 39*e* of ramp assembly 38*e*, and pedals 28*e*, 30*e* are located below and behind respective pivot points 33*e*, 35*e*, thereby providing a long length of travel for the wheels of assemblies 32*e*, 34*e* while providing an efficient footprint.

As further illustrated in FIGS. 16-21, device 10*e* further includes a resistance assembly 36*e* coupled to pivoting assemblies 32*e*, 34*e*. As depicted in FIGS. 16-21, the resistance assembly 36*e* of embodiment 10*e*, contains a pair of upper pulleys 172*e*, 174*e* attached to top beam member 58*e*, a pair of one-directional clutches 168*e*, 170*e* attached to front beam member 54*e*, a crossover pulley 176*e* attached to beam assembly 112*e*, a flywheel 86*e* that is coaxially located to said one-directional clutches 168*e*, 170*e* and a braking device 88*e*. Framework 12*e* and resistance assembly 36*e* are substantially located in between first pivoting assembly 32*e* and second pivoting assembly 34*e*. This allows easy access to the resistance assembly of the exercise device rather than having a cage surrounding the resistance assembly. The control console, belts and cables have been omitted from FIGS. 14-19 for the convenience of illustrating embodiment 10*e*.

FIG. 17 portrays another perspective of embodiment 10*e*, highlighting the linking assembly showing the multiple link and support members forming the pivoting assemblies 32*e*, 34*e*.

Figure 18:
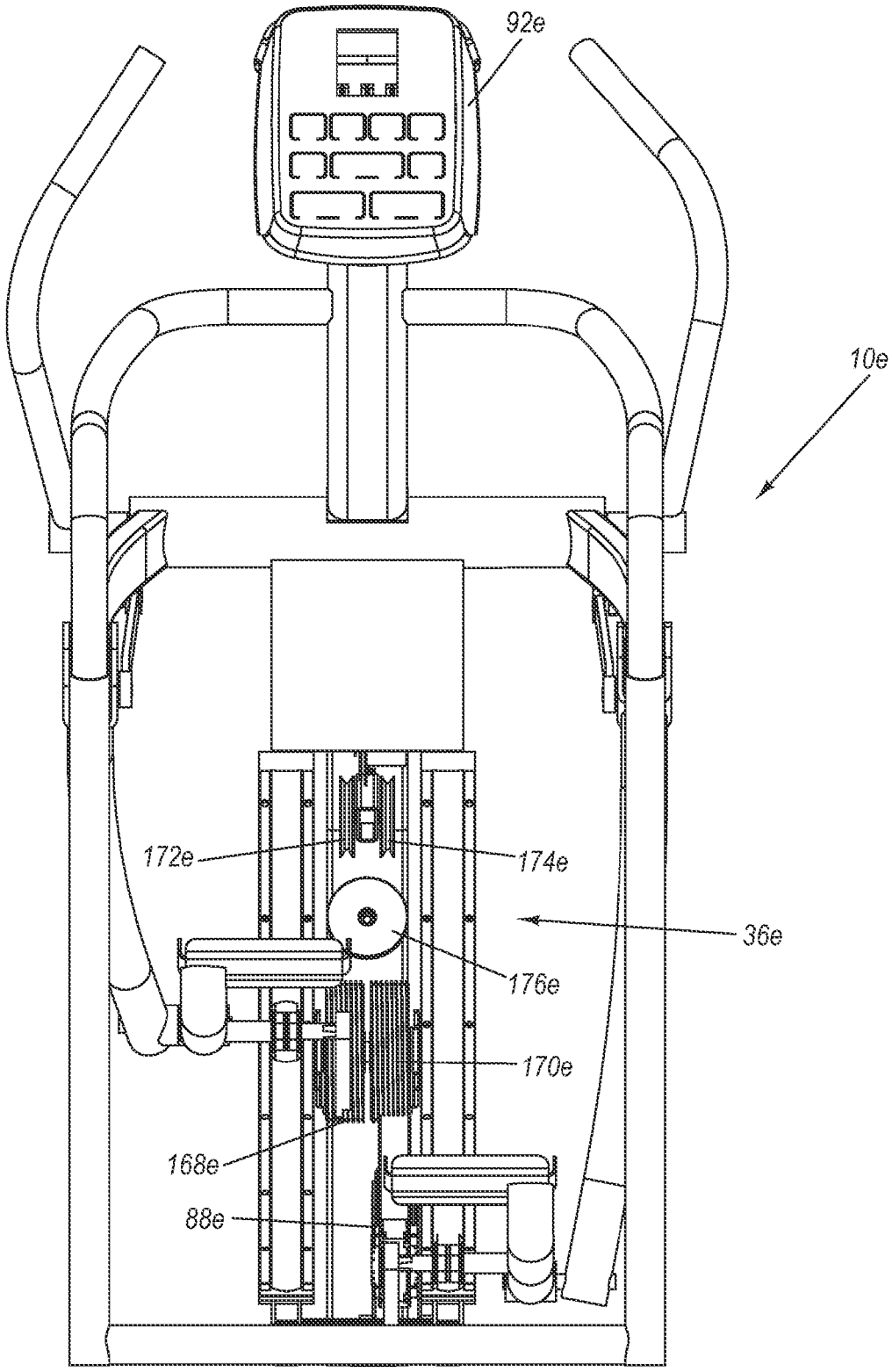
FIG. 18 is rear view of the embodiment of the exercise device of FIG. 14.
Figure 21:
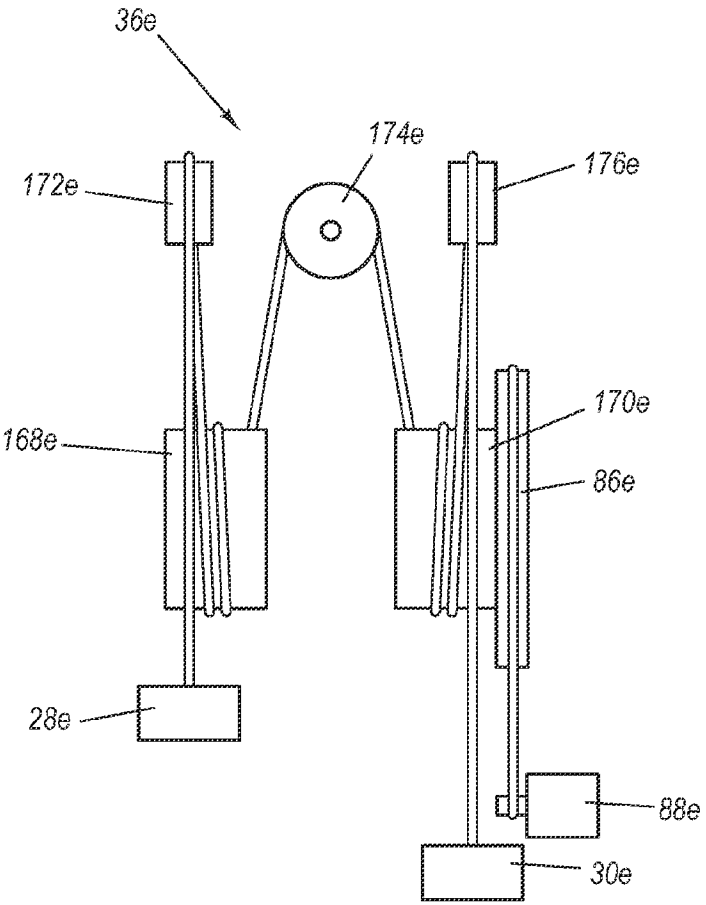
FIG. 21 is a rear schematic view of the resistance assembly of the embodiment of FIG. 14.
Figure 20:
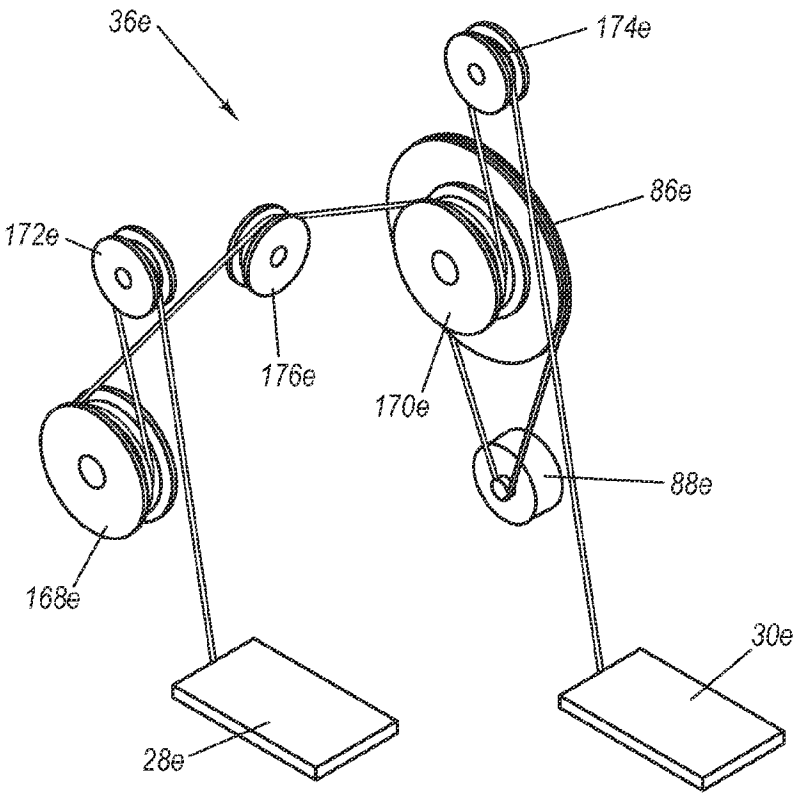
FIG. 20 is a schematic view of the resistance assembly of the embodiment of FIG. 14.

FIG. 18 illustrates that resistance assembly 36*e* includes a linking system of embodiment 10*e* of the exercise device that serves as a linking system, linking pivoting assemblies 32*e*, 34*e*, such that movement of assembly 32*e* causes a reciprocal, linked movement of assembly 34*e*. As shown in FIGS. 20 and 21, the resistance assembly 36*e* comprises a pulley and cable system that imparts a dependent, reciprocal movement upon the pivoting assemblies 32*e*, 34*e*. FIGS. 20 & 21 depict schematic views of the resistance assembly 36*e* of embodiment 10*e*, showing a cable linking first foot platform 28*e* to second foot platform 30*e* using various components of resistance assembly 36*e*.

Resistance assembly 36*e* links the movement of first pivoting assembly 32*e* to second pivoting assembly 34*e*. The movement of pivoting assemblies 32*e*, 34*e* may be arrested by respective stops connected to the top and/or bottom of the ramp assembly 38*e*. In one embodiment, only stops at the top end or the bottom end of the ramp assembly are employed while movement at the opposite end is arrested by the available cable length of the resistance assembly 36*e*. In another embodiment, stops are employed at the top and bottom ends of the ramp assembly.

FIGS. 22-27 feature an embodiment of an exercise device 10*f* that is similar to the exercise device 10*e* embodiment of FIGS. 14-21. For example, previously described resistance assembly 36*e* of FIGS. 14-21 may be employed in conjunction with device 10*f* of FIGS. 22-27. Furthermore, the stride lengths and stride length to framework footprint length ratios described with regard to the device 10*e* of FIGS. 14-21 may be applicable to device 10*f* of FIGS. 22-27. Platform 192*e* shown in FIG. 22 attached to rear second stabilizer member 52*f* allows a user to conveniently access and address foot platforms 28*f*, 30*f*.

FIG. 22 provides a side view of the embodiment of the exercise device 10*f* with pivoting assemblies 32*f*, 34*f* shown in the neutral position, such that assemblies 32*f*, 34*f*, are aligned when viewed from the side, as shown in FIG. 22. Such assemblies 32*f*, 34*f* may operate identically or similarly to previously described pivoting assemblies 32*e*, 34*e* for example. As shown, this design is highly efficient and provides a small, efficient footprint. The pivot points 33*f*, 35*f* of pivoting assemblies 32*f*, 34*f* are substantially positioned over a central portion 39*f* of ramp assembly 38*f*, resulting in the pivot assemblies 32*f*, 34*f* remaining substantially within the footprint length 113*f* of framework during use. Furthermore, pedals 28*f*, 30*f* of pivoting assemblies 32*f*, 34*f* are located below and behind pivot points 33*f*, 35*f* in the neutral position of FIG. 22. As a result of the configuration of device 10*f*, the wheels of respective pivoting assemblies 32*e*, 34*e* move along the length of respective ramps of ramp assembly 38*f*, providing a long length of travel, and the overall device 10*f* has an efficient, small footprint. Thus, as shown in FIG. 22, device 10*f* features pivot points 33*f*, 35*f* positioned over a central portion 39*f* of ramp assembly 38*f*, and pedals 28*f*, 30*f* are located below and behind respective pivot points 33*f*, 35*f*, thereby providing a long length of travel for the wheels of assemblies 32*f*, 34*f* while providing an efficient footprint.

Elastomeric stops 194 (see FIG. 22) can be connected to the top and/or bottom ends of respective ramps to arrest progress of the pivoting assemblies 32*f*, 34*f*.

As discussed previously, adjustable screw motor 116*c* described in FIG. 11-12 is an example of means for adjusting the neutral body position of the user of the exercise device with respect to a support surface. Thus, one example of said means for adjusting the neutral body position of a user may comprise a lead screw mounted at a position such that a rotation imparted upon said lead screw imparts an upward or downward movement of a foot support member. Such a lead screw assembly or a similar assembly may optionally be used in the embodiments of FIGS. 14-21 and/or 22-27. Another example of a means for adjusting the neutral body position of the user of the exercise device with respect to a support surface is an adjustable pulley system that may be used to alter the orientation of the pedals of the foot support members 24*e*, 26*e*, thereby adjusting the neutral body position of the user. For example, pulleys 172*e*, 174*e* can be configured so as to be adjustably moveable with respect to framework 112*e*, such that when the pulleys are moved upward or downward along the framework 112*e*, the position of the foot support assemblies 24*e*, 26*e* and the foot platforms 28*e*, 30*e* move with respect to the framework 112*e*, thereby adjusting the neutral body position of the user of the exercise device with respect to a support surface. Other examples of means for adjusting the neutral body position of the user of the exercise device with respect to a support surface include, but are not limited to, gear assemblies, hydraulic assemblies, an elastic resistance assemblies, and the like.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed is:

1. An exercise apparatus comprising:

a stationary framework having at least one ramp;

a first handle assembly pivotally coupled to the framework;

a first pivoting assembly coupled to the framework at a first pivot point, the first pivoting assembly comprising a first link arm having a first end and an opposing second end, wherein the first end of the first link arm is pivotally coupled to the framework at the first pivot point, a first foot support pivotally coupled to the second end of the first link arm, wherein the first foot support is movably mounted on the at least one ramp, and a first connecting arm pivotally coupling the first link arm to the first handle assembly, wherein a first end of the first connecting arm is pivotally coupled directly to the first link arm and a second end of the first connecting arm is pivotally coupled directly to the first handle assembly and wherein movement of the first link arm causes movement of the first handle assembly; and a second pivoting assembly coupled to the framework at a second pivot point, the second pivoting assembly comprising a second link arm having a first end and an opposing second end, the first end of the second link arm pivotally coupled to the framework at the second pivot point, and a second foot support pivotally coupled to the second end of the second link arm, wherein the second foot support is movably mounted on the at least one ramp.

2. The exercise apparatus of claim 1 wherein each of the first and second foot support have a free end that moves along the at least one ramp.

3. The exercise apparatus of claim 1, wherein a first wheel movably couples the first foot support member to the at least one ramp, said first wheel being capable of movably rolling upon said at least one ramp.

4. The exercise apparatus of claim 1, wherein the at least one ramp comprises a first spaced ramp and a second ramp spaced apart from the first ramp.

5. The exercise apparatus of claim 1, wherein the motion of the pivot assemblies is substantially restricted to the footprint defined by the framework.

6. The exercise apparatus of claim 1, wherein said framework comprises a main body, said main body has a horizontal footprint located within the distance in between said first and second link arms.

7. An exercise apparatus comprising:

a framework having at least one curved ramp;

a resistance assembly coupled to the framework;

a cable and pulley system operatively associated with the resistance assembly;

a first pivoting assembly coupled to the framework at a first pivot point, the first pivoting assembly comprising a first link arm having a first end and an opposing second end, wherein the first end of the first link arm is pivotally coupled to the framework at the first pivot point, a first foot support pivotally coupled to the second end of the first link arm, and a first pedal mounted on the first foot support, the first foot support movably mounted on the at least one curved ramp; and a second pivoting assembly coupled to the framework at a second pivot point, the second pivoting assembly comprising a second link arm, a second foot support coupled to the second link arm, and a second pedal mounted on the second foot support, the second foot support movably mounted on the at least one curved ramp, wherein, when the first and second pivoting assemblies are in a neutral, aligned position, the first and second pedals are below and behind the first and second pivot points, respectively, and wherein a cable of the cable and pulley system connects the first pivoting assembly to the second pivoting assembly.

8. The exercise apparatus of claim 7, wherein a reciprocating displacement of each foot support member substantially corresponds to a curved shape of the at least one ramp.

9. An exercise apparatus comprising:

a framework having first and second side members;

a first link arm and a second link arm, said first link arm and said second link arm each having a first end and an opposing second end, each of said link arms being pivotally attached at a respective first end to the first and second side members, respectively;

a first foot support member and a second foot support member, said first foot support member having a first end pivotally attached to said second end of said first link arm, said second foot support member having a first end pivotally attached to said second end of said second link arm, each of said foot support members having a second opposing free end movably mounted on said framework, wherein the first and second foot support members are positioned below the first and second side members; and a cable and pulley system secured to said first foot support member and said second foot support member, wherein a first end of a cable of said cable and pulley system is secured to said first foot support member and a second end of said cable is secured to said second foot support member, wherein movement of said first foot support member is linked to movement of said second foot support member.

10. The exercise apparatus of claim 9, wherein the framework comprises a beam assembly and a ramp assembly, said ramp assembly comprising at least one ramp.

11. The exercise apparatus of claim 9, wherein the framework comprises at least one curved ramp.

12. An exercise apparatus comprising:

a stationary framework comprising a ramp assembly;

a handle assembly pivotally coupled to the framework:

first and second link arms, each link arm having a first end and an opposing second end, each of said first and second link arms being pivotally attached at a respective first end directly to said framework;

first and second foot support members, each foot support member having a first end pivotally attached directly to a respective second end of the first and second link arms, each of said foot support members having a second opposing end movably mounted on said ramp assembly;

wherein each of said foot support members has a reciprocating stride motion and is movably mounted on said ramp assembly and is configured to reciprocate along said ramp assembly with a variable reciprocating stride length, wherein the stride length can be varied by a user during exercise.

13. The exercise apparatus of claim 12, wherein each of the foot support members has an attached wheel, each of said attached wheel movably mounts a free end of each foot support member on said ramp assembly, each of said attached wheel being capable of movably rolling upon said ramp assembly.

14. The exercise apparatus of claim 13, wherein the stride motion of each of the foot support members is determined by the motion of each of the attached wheels as said wheels travel along said ramp assembly.

15. An exercise apparatus comprising:

a framework comprising a ramp assembly, said ramp assembly comprising at least one ramp having a curved configuration;

a first link arm pivotally coupled directly to said framework and a second link arm pivotally coupled directly to said framework;

a first foot support member and a second foot support member each having a first end and an opposing second end, wherein the first end of the first foot support member is pivotally coupled directly to the first link arm at a first pivot point and the first end of the second foot support member is pivotally coupled directly to the second link arm at a second pivot point, wherein the opposing second end of each of the first and second foot support members is movably mounted on said at least one curved ramp, and wherein when the first and second foot support members are in a neutral, aligned position, the first and second support members are below the first and second pivot points, respectively; and a cable and pulley system linking the first foot support member to the second foot support member, wherein movement of the first foot support member causes movement of the second foot support member, thereby enabling a user to vary the stride length of the first and second foot support members during exercise.

16. The exercise apparatus of claim 15, wherein length of stride motion for an exercise routine is determined through the input of force by the user.

17. The exercise apparatus of claim 15, wherein each of the foot support members has a wheel attached to the opposing second end thereof to thereby movably mount respective foot support members on said at least one ramp.

18. The exercise apparatus of claim 17, wherein each wheel can move at least about 30 inches along an arc of the at least one ramp.

19. The exercise apparatus of claim 17, wherein each wheel can move at least about 35 inches along an arc of the at least one ramp.

20. The exercise apparatus of claim 17, wherein each wheel can move at least about 40 inches along an arc of the at least one ramp.

21. The exercise apparatus of claim 17, wherein each wheel can move at least about 44 inches along an arc of the at least one ramp.

22. The exercise apparatus of claim 15, wherein the at least one ramp has an arc length of at least about 30 inches.

23. The exercise apparatus of claim 15, wherein the at least one ramp has an arc length of at least about 35 inches.

24. The exercise apparatus of claim 15, wherein the at least one ramp has an arc length of at least about 40 inches.

25. The exercise apparatus of claim 15, wherein the at least one ramp has an arc length of at least about 45 inches.

26. An exercise apparatus comprising:

a stationary framework comprising at least one ramp, wherein the framework has a proximal end positioned in front of a user during exercise;

a first pivoting assembly coupled to the framework at a first pivot point, the first pivoting assembly comprising a first link arm pivotally coupled directly to the framework at the first pivot point and a first foot support pivotally coupled directly to the first link arm at a third pivot point, wherein the first pivot point is above the third pivot point;

a second pivoting assembly coupled to the framework at a second pivot point, the second pivoting assembly comprising a second link arm pivotally coupled directly to the framework at the second pivot point and a second foot support pivotally coupled directly to the second link arm at a fourth pivot point, wherein the second pivot point is above the fourth pivot point; and wherein each respective portion of the first and second pivoting assemblies has a maximum stride length defined as a maximum distance that each of said respective portions moves along the at least one ramp, wherein said maximum stride length is at least about 25% of the footprint length of the framework of the exercise device.

27. The exercise apparatus of claim 26, wherein each of said respective portions comprises a wheel that moves along the at least one ramp.

28. The exercise apparatus of claim 26, wherein said maximum stride length is at least 35% of the footprint length of the framework of the exercise device.

29. The exercise apparatus of claim 26, wherein said maximum stride length is at least 45% of the footprint length of the framework of the exercise device.

30. The exercise apparatus of claim 26, wherein said maximum stride length is at least 55% of the footprint length of the framework of the exercise device.

31. The exercise apparatus of claim 26, wherein said maximum stride length is at least 65% of the footprint length of the framework of the exercise device.

32. The exercise apparatus of claim 26, wherein said maximum stride length is at least 75% of the footprint length of the framework of the exercise device.

33. An exercise apparatus comprising:

a framework;

a ramp assembly coupled to said framework, said ramp assembly comprising at least one ramp;

a first pivoting assembly coupled to the framework at a first pivot point, the first pivoting assembly comprising:

a first link arm having a first end and a second end, wherein the first end of the first link arm is pivotally coupled directly to the framework at the first pivot point, a first foot support pivotally coupled directly to the second end of the first link arm at a third pivot point, wherein the first pivot point is above the third pivot point, and a first wheel pivotally coupled to the first foot support, the first wheel being movably mounted on the at least one ramp;

a second pivoting assembly coupled to the framework at a second pivot point, the second pivoting assembly comprising:

a second link arm having a first end and a second end, wherein the first end of the second link arm is pivotally coupled directly to the framework at the second pivot point, a second foot support pivotally coupled directly to the second end of the second link arm at a fourth pivot point, wherein the second pivot point is above the fourth pivot point, and a second wheel pivotally coupled to the second foot support, the second wheel being movably mounted on the at least one ramp, wherein the pivoting assemblies move in a reciprocating, striding motion, and wherein the first and second wheels each have a maximum stride length defined as a maximum distance that each of said wheels moves along the at least one ramp, wherein said maximum stride length can be varied by a user during exercise.

34. The exercise apparatus of claim 33, wherein said maximum stride length is at least about 35 inches.

35. The exercise apparatus of claim 33, wherein said maximum stride length is at least about 40 inches.

36. The exercise apparatus of claim 33, wherein said maximum stride length is at least about 44 inches.

37. The exercise apparatus of claim 33, wherein said maximum stride length is at least about 30 inches.

* * * * *